US011213149B2

(12) United States Patent
Hsu

(10) Patent No.: US 11,213,149 B2
(45) Date of Patent: Jan. 4, 2022

(54) ERGONOMIC CHOPSTICKS

(71) Applicant: Fred Hsu, Port Washington, NY (US)

(72) Inventor: Fred Hsu, Port Washington, NY (US)

( * ) Notice: Subject to any disclaimer, the term of this patent is extended or adjusted under 35 U.S.C. 154(b) by 191 days.

(21) Appl. No.: 16/695,029

(22) Filed: Nov. 25, 2019

(65) Prior Publication Data

US 2021/0059445 A1 Mar. 4, 2021

Related U.S. Application Data

(60) Provisional application No. 62/894,865, filed on Sep. 2, 2019.

(51) Int. Cl.
*A47G 21/10* (2006.01)
*A47G 21/06* (2006.01)

(52) U.S. Cl.
CPC ..... *A47G 21/103* (2013.01)

(58) Field of Classification Search
CPC ..... A47G 21/103
USPC ..... 294/218
See application file for complete search history.

(56) References Cited

U.S. PATENT DOCUMENTS 2,263,885 A * 11/1941 McGauley ..... A46B 5/02 15/143.1
5,277,464 A 1/1994 Okun
6,105,259 A * 8/2000 Meyers ..... A47G 21/02 30/150
8,235,440 B2 8/2012 Park
8,562,054 B2 10/2013 Keller
9,155,411 B2 10/2015 Woo
2009/0066097 A1* 3/2009 Lin ..... A47G 21/14 294/218
2012/0133167 A1 5/2012 Woo
2014/0265402 A1 9/2014 Pecoraro

FOREIGN PATENT DOCUMENTS

CN 101991331 * 3/2011
CN 101991331 A 3/2011
CN 104257228 A 1/2015
GB 2234425 * 2/1991
GB 2234425 A 2/1991
GB 2452978 * 3/2009
JP H10137101 A 5/1998
JP H10228234 A 8/1998
JP 3078843 U 7/2001

(Continued)

*Primary Examiner* — Dean J Kramer

(57) ABSTRACT

Ergonomic chopsticks come with low-profile protrusions that are strategically placed. These protrusions generate tactile feedback on particular surfaces of a user's fingers, without hindering normal movements of fingers and chopsticks. They guide beginners and lifelong users alike to adopt a proper chopstick grip, allowing users to extend chopstick tips wide apart over an angle of 40 degrees. They help users twirl chopsticks from the closed posture to the wide-open posture, and back, based on principles of the planetary gear train, while ensuring that fingers and chopsticks stay within the standard grip form. As a result, a user can wield ergonomic chopsticks to embrace large food items with ease, manipulate these large items with dexterity and finesse in the same way she can small items, and generate enough compression force to hold all items firmly between ergonomic chopsticks.

20 Claims, 19 Drawing Sheets

(56) References Cited

FOREIGN PATENT DOCUMENTS

| | | | | | |
|---|---|---|---|---|---|
| JP | 3089628 | U | | 10/2002 | |
| JP | 3133200 | U | | 7/2007 | |
| JP | 6366159 | B2 | | 8/2018 | |
| WO | WO-2005072569 | A1 | * | 8/2005 | ..... A47G 21/103 |
| WO | WO-2013094888 | A1 | * | 6/2013 | ..... A47G 21/103 |
| WO | 2013181822 | A1 | | 12/2013 | |

* cited by examiner

ERGONOMIC CHOPSTICKS

CROSS-REFERENCE TO RELATED APPLICATION

This application claims the benefit of U.S. Provisional Patent Application No. 62/894,865, filed Sep. 2, 2019, which is incorporated by reference herein in its entirety.

TECHNICAL FIELD OF THE INVENTION

Various embodiments of the present invention relate to chopsticks, and in particular to ergonomic chopsticks with tactile feedback that drive beginners and lifelong users alike toward the standard grip and its finger movement, resulting in the ability to extend the tips of the chopsticks wide apart to embrace a food item, to manipulate chopsticks with dexterity, and to generate enough compression force to hold the item firmly between tips, with ease.

BACKGROUND OF THE INVENTION

Unlike forks and spoons, chopsticks are not intuitive to use. There are many ways for a human hand to grip a pair of chopsticks, and to wield them such that the tips of the chopsticks can be made to grasp and to release food items. However, only one grip is generally considered the standard way to manipulate chopsticks, based on ergonomic considerations. This standard grip is not a single static configuration of fingers and chopsticks, but a fluid and concerted motion of fingers pushing, pulling and rolling the chopsticks, moving them back and forth between two ends of a range of configurations.

FIG. 2W illustrates the wide-open end of this range, with the tips of the chopsticks spread apart wider than the width of the palm. FIG. 2C illustrates the closed end of this range, where tips touch. In order to manipulate the two chopsticks in between these two ends, the hand alternates between the wide-open posture where the index finger and the middle finger are uncurled (FIG. 2W), and the closed posture where these two fingers are curled (FIG. 2C).

The closed posture in FIG. 2C is a familiar sight to many people. But the wide-open posture in FIG. 2W, and the full range of finger movements are not well-understood nor well-studied. These two representative drawings are created after extensive reviews of photos and slow-motion videos of proficient users wielding chopsticks with the standard grip.

While examining these videos, I made some new observations. As shown in FIG. 10W and FIG. 10C, the alternating motion between wide-open and closed postures not only changes the pitch angle of the top chopstick 20 around its lateral axis 26, but also rolls it back and forth, around its longitudinal axis 27, as can be revealed by following the movement of striped mark 23 at the rear end of top chopstick 20. This roll is a key element of how chopsticks actually work, and explains the puzzling popularity of square chopsticks over round ones. The edges from a square chopstick allow the thumb, the index finger, and the middle finger to maintain a firm grip on the stick for the roll, without having to assert extensive pressure throughout the entire alternating motion.

I further noticed that the roll is correlated with the way the three fingers achieve the change in the pitch angle, as a result of the anatomy of the hand. At the first glance, the alternating motion appears to be just two fingers—index and middle—flicking and then bending. Some published literatures refer to this as simply a third-class Archimedean lever, where the two fingers rotate the top chopstick using the thumb as a static fulcrum on a single plane of rotation. This narrative does not account for the roll I have discovered while observing actual usages of chopsticks.

What really happens is that three fingers—thumb, index and middle—twirl top chopstick 20 back and forth simultaneously around two axes, the lateral axis 26 and the longitudinal axis 27 (FIG. 10W). This twirling motion is similar to techniques used in drumstick twirling and pen twirling. There isn't a static fulcrum, and the stick does not rotate only on one plane. Furthermore, the thumb is not a passive participant in this motion, despite its seemingly static stance. When moving from the wide-open posture shown in FIG. 10W to the closed posture shown in FIG. 10C, the thumb twirls top chopstick 20, in opposition to the index and the middle fingers, to generate roll 29, as the index finger twirls tip 21 downward to achieve flexion 28. The finger-chopstick dynamics resembles that of a planetary gear train, with the top chopstick as the sun gear, and the three fingers as planet gears, shown in FIG. 10T. The outer gear ring is omitted in this drawing.

Whereas published literatures on chopsticks treat the thumb as a static fulcrum in a third-class Archimedean lever (the top chopstick), the reality is more nuanced, as mentioned. The dynamics and mechanical advantages of chopstick wielding can be better described in terms of gear trains. Fingers mesh with surfaces of a chopstick, and twirl the chopstick to impart torque without having to drag sensitive finger skin repeatedly against any surface. Note, for instance, where top chopstick 20 intersects the thumbnail at the wide-open posture in FIG. 10W, and compare this presumed static fulcrum to the location of the same intersection in the closed posture in FIG. 10C. The intersection point has shifted downwards significantly to reveal the fact that top chopstick 20 has been rolled in a twirling motion. The resulting roll can be further confirmed by examining stick marks left by the top chopstick on the thumb, illustrated in FIG. 11T by mark 123*t* at the wide-open posture, and mark 133*t* at the closed posture. This twirling motion is a central component of the standard grip. It explains why the seemingly lever-like motion does not cause chopsticks to repeatedly rub against sensitive finger skin. It enables the human hand to exercise dexterity to achieve the full range of finger configurations between the two postures. This dexterity in turns allows the hand to manipulate both small and large food items, with either miniscule or significant clutching forces as situations call for.

At the same time, I found that the bottom chopstick is not a static component, despite popular understanding to the contrary. FIG. 10W and FIG. 10C show that the base segment of the thumb also nudges and twirls bottom chopstick 30, in opposition to the ring finger. As a result, bottom chopstick 30 changes its pitch angle around its lateral axis 36, and rolls around its longitudinal axis 37. This movement is subtle, compared to that of top chopstick 20. It is most noticeable when tip 31 needs to be moved downward and outward with force via extension 34, especially when pushing with tension against obstacles, as is the case when slicing open soft mass such as an omelette from within. This movement is also visible when the ring finger leverages the thumb to maintain prolonged compression pressure on food items via flexion 38, as is the case when slicing open an omelette from the outside. This rolling movement can be confirmed by stick marks left by the bottom chopstick on the ring finger, illustrated in FIG. 11B by mark 124*r* at the wide-open posture, and mark 134*r* at the closed posture. Again, the roll explains why repeated lever-like extensions and flexions do not result in friction blisters on fingers. And again, the finger-chopstick dynamics resembles that of a planetary gear train, shown in FIG. 10B.

These ergonomic insights inspire various embodiments of the present invention, and distinguish these embodiments from published literatures that examine only a fraction of the full alternating motion, incognizant of the nuances of how the human hand actually manipulates chopsticks using gear train principles. Inspirations include:

1. Full range of postures from closed to wide-open
2. Proper tension force
3. Proper compression force
4. Extension and flexion of the top chopstick around its lateral axis
5. Roll of the top chopstick around its longitudinal axis
6. Extension and flexion of bottom chopstick around its lateral axis
7. Roll of the bottom chopstick around its longitudinal axis
8. Finger-chopstick dynamics of the standard grip motion
9. Mechanical advantages of the planetary gear train

BRIEF SUMMARY OF THE INVENTION

As stated earlier, chopsticks are not intuitive to use. An adult beginner cannot be expected to work out all the nuances of the standard grip by trial and error, in public and under peer pressure. Many beginners manage to quickly find simpler but suboptimal grips that allow them to eat with chopsticks. Some find themselves stuck in their own alternative grip with a limited range of motion, and without much tension or compression force. This issue is not limited to adult beginners; a large percentage of lifetime chopstick users in Asia never venture out of various alternative grips adopted in childhood.

The first embodiment of the present invention provides users with a pair of modified chopsticks with subtle protrusions strategically- and ergonomically-placed, such that they generate tactile feedback on particular surfaces of fingers, without hindering movements of fingers and chopsticks. The unobtrusive tactile feedback compels fingers to adopt the standard grip and the full alternating motion between the wide-open posture and the closed posture, as illustrated in FIG. 1W and FIG. 1C, respectively. Compare this embodiment to plain chopsticks in FIG. 2W and FIG. 2C, to ascertain that throughout the alternating motion, all contacts between fingers and chopsticks otherwise made using plain chopsticks remain unperturbed and unchanged with the use of this embodiment.

This embodiment contrasts with published derivations of chopsticks that rely on conspicuous appendages or deformed sticks to emulate parts of the standard grip, but not the complete experience. Some limit the range of finger motions. Some have parts that rub against sensitive finger skin, as chopsticks are manipulated. Others compel finger movements to deviate from standard grip movements. Most focus only on establishing a proper static finger configuration at the closed posture. These published devices are appropriately called learning, training, correction, alternative or simplified chopsticks. They do not replace plain chopsticks, but serve as a crutch before a user moves up to plain chopsticks, and wields them with the standard grip in ways these devices do not allow.

Embodiments of the present invention, the ergonomic chopsticks, are operated exactly like plain chopsticks. Users can continue to wield them in formal eating situations without embarrassment, even after full mastery of the standard grip. The first embodiment, shown in FIG. 4W and FIG. 4C, connects all protrusions to form two contiguous, low-profile nuggets 40 and 50, one on each chopstick. Other embodiments of the invention may be attached to a user's own plain chopsticks, as shown in FIG. 14T and FIG. 14B.

These ergonomically-placed nuggets cover key surfaces of the two chopsticks, such that in spite of their unobtrusiveness, they provide desirable tactile feedback to fingers via contact interfaces, throughout the alternating motion between the wide-open posture and the closed posture, as illustrated in FIG. 6W and FIG. 8C.

In all embodiments, "ergonomic chopsticks" are defined as a pair of plain chopsticks with some ergonomic nuggets mounted on them. In FIG. 4W, ergonomic chopsticks 80 and 90 are created by fixedly connecting ergonomic nuggets 40 and 50 to plain chopsticks 20 and 30, respectively. In FIG. 14T and FIG. 14B ergonomic chopsticks are created by attaching removable ergonomic nuggets 60 and 61 to plain chopsticks 20 and 30, respectively. Ergonomic chopsticks are designed to teach and uphold the standard grip and its full alternating finger motion—nothing more, nothing less.

This strict preservation of plain chopsticks and standard grip distinguishes the ergonomic chopsticks from published devices which generally fall into one of these camps:

1. Eschew the standard grip altogether—two sticks are connected somehow, so that users can wield them like tweezers, tongs or scissors. These do not teach the standard grip nor its finger dynamics at all.
2. Avoid having to learn the finger dynamics of the standard grip—finger hoops and/or simulated chopstick pivots are provided, such that users can affect the appearance of the standard grip, without having to learn to hold chopsticks securely and to twirl them with fingers. These teach the standard grip posture, but not its finger dynamics.
3. Focused only on the initial finger placement—chopsticks are deformed, carved, or adorned with tabs or spacers, to force users to keep fingers in the same static locations for the closed posture as shown in FIG. 2C, throughout the entire alternating motion. These are designed without the insight that the standard grip operates on principles of the planetary gear train. These devices hinder chopstick rolls, teach incorrect finger dynamics, weaken mechanical advantages, and generally restrain fingers from achieving the wide-open posture as shown in FIG. 2W.

In comparison, ergonomic chopsticks allow fingers to achieve some or all of these:

1. Find the right, everchanging positions on chopsticks, throughout the alternating motion.
2. Prevent the top chopstick from slipping out of the grasp of the thumb, the index finger, and the middle finger, along its longitudinal axis.
3. Twirl the top chopstick, while preventing it from rolling beyond required degrees at either ends of the alternating motion.
4. Prevent the bottom chopstick from slipping out of the grasp of the thumb and the ring finger, along its longitudinal axis.
5. Twirl the bottom chopstick assisted by the shape of the ergonomic nugget, which hugs the contours of the thumb and the ring finger, throughout the alternating motion.
6. Operate ergonomic chopsticks in exactly the same way as they would plain chopsticks.
7. Leverage principles of the planetary gear train in wielding chopsticks.

Further areas of applicability of the present invention will become apparent from the detailed description provided hereinafter. It should be understood that the detailed description and specific examples, while indicating some embodiments of the invention, are intended for purposes of illustration only and are not intended to limit the scope of the invention.

REFERENCE NUMERALS

Figure 1W:
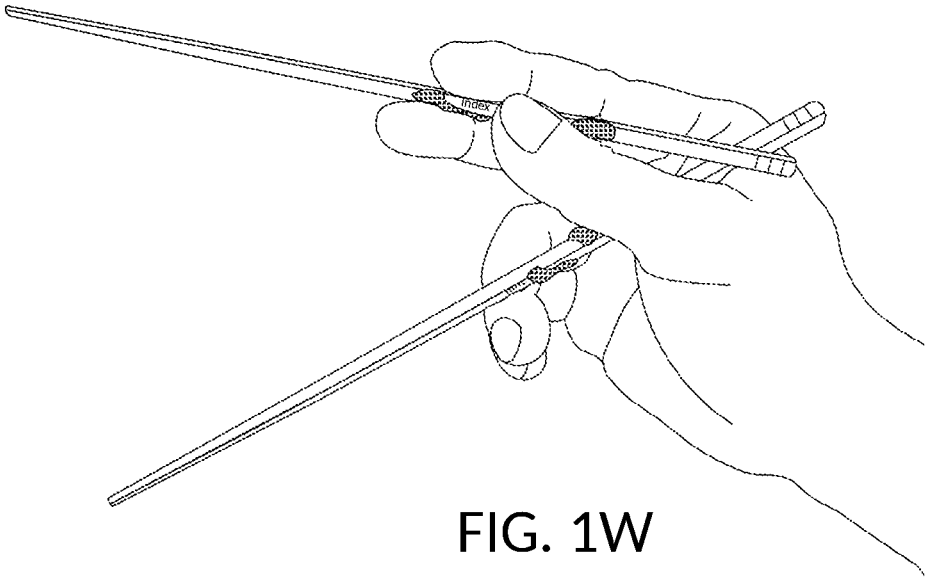
FIG. 1W is a view of a right hand holding the first embodiment of the present invention, the ergonomic chopsticks, at the wide-open end of the standard grip and motion, where the tips of the chopsticks are spread apart wider than the width of the palm.

It is noted that like parts are designated by like reference numerals throughout the accompanying drawings. A list of numbered parts is presented below:

20. Plain top chopstick
21. Tip of top chopstick 20
22. Rear end of top chopstick 20
23. Striped mark at the rear end of top chopstick 20, for illustration purposes only
24. Extension of top chopstick 20 around lateral axis 26 to move tip 21 away from tip 31
25. Roll of top chopstick 20 around longitudinal axis 27 top move tip 21 away from tip 31
26. Lateral axis of top chopstick 20
27. Longitudinal axis of top chopstick 20
28. Flexion of top chopstick 20 around lateral axis 26 to bring tip 21 towards tip 31
29. Roll of top chopstick 20 around longitudinal axis 27 to bring tip 21 towards tip 31
30. Plain bottom chopstick
31. Tip of bottom chopstick 30
32. Rear end of bottom chopstick 30
33. Striped mark at the rear end of bottom chopstick 30, for illustration purposes only
34. Extension of bottom chopstick 30 around lateral axis 36 to move tip 31 away
35. Roll of bottom chopstick 30 around longitudinal axis 37 to move tip 31 away
36. Lateral axis of bottom chopstick 30
37. Longitudinal axis of bottom chopstick 30
38. Flexion of bottom chopstick 30 around lateral axis 36 to bring tip 31 towards tip 21
39. Roll of bottom chopstick 30 around longitudinal axis 37 to bring tip 31 towards tip 21
40. Contiguous, low-profile ergonomic nugget on top chopstick 20: first embodiment
41. Middle finger contact interface on nugget 40 at the wide-open posture
42. Index fingertip contact interface on nugget 40 at the wide-open posture
43. Index finger side contact interface on nugget 40 at the wide-open posture
44*a*. Thumb contact interface on nugget 40 at the wide-open posture
44*b*. Thumb contact interface on nugget 40 at the wide-open posture
45. Index fingertip contact interface on nugget 40 at the closed posture
46. Index finger side contact interface on nugget 40 at the closed posture
47*a*. Thumb contact interface on nugget 40 at the closed posture
47*b*. Thumb contact interface on nugget 40 at the closed posture
48. Thumb contact interface on nugget 40 at the closed posture
49. Index finger base contact interface on nugget 40 at the closed posture
50. Contiguous, low-profile ergonomic nugget on bottom chopstick 30: first embodiment
51. Ring finger contact interface on nugget 50 at the wide-open posture
52. Thumb contact interface on nugget 50 at the wide-open posture
55. Ring finger contact interface on nugget 50 at the closed posture
56. Thumb contact interface on nugget 50 at the closed posture
60. A removable version of top nugget 40—second embodiment
61. A removable version of bottom nugget 50—second embodiment
63. Contiguous fingerprint made by the fingers on top chopstick 20
64. Contiguous fingerprint made by the ring finger on bottom chopstick 30
65. Contiguous fingerprint made by the thumb and the purlicue on bottom chopstick 30
70. An extended version of bottom nugget 50 with roll limit feedback: third embodiment
71. Ring finger contact interface on nugget 70 at the wide-open posture
72. Thumb contact interface on nugget 70 at the closed posture
75. First disjoint nugget portion on top chopstick 20: fourth embodiment
76. Second disjoint nugget portion on top chopstick 20: fourth embodiment

77. Third disjoint nugget portion on top chopstick 20: fourth embodiment
78. Fourth disjoint nugget portion on top chopstick 20: fourth embodiment
80. Ergonomic top chopstick=plain chopstick 20+ergonomic nugget 40
88. A dragon-shaped version of top nugget 40: fifth embodiment
90. Ergonomic bottom chopstick=plain chopstick 30+ergonomic nugget 50
99. A dragon-shaped version of bottom nugget 50: fifth embodiment
100*t*. Thumb of a right hand
100*i*. Index finger of a right hand
100*m*. Middle finger of a right hand
100*r*. Ring finger of a right hand
100*p*. Purlicue of a right hand
111. Tip segment of a finger
111*t*. Tip segment of the thumb
111*i*. Tip segment of the index finger
112. Center segment of a finger
113. Base segment of a finger
113*t*. Base segment of the thumb
114. Distal knuckle between the tip segment and the center segment of a finger
114*m*. Distal knuckle of the middle finger
114*r*. Distal knuckle of the ring finger
123*t*. Stick mark left by a top chopstick on thumb 100*t* at the wide-open posture
123*i*. Stick mark left by a top chopstick on index finger 100*i* at the wide-open posture
123*m*. Stick mark left by a top chopstick on middle finger 100*m* at the wide-open posture
124*r*. Stick mark left by a bottom chopstick on ring finger 100*r* at the wide-open posture
125*t*. Stick mark left by a bottom chopstick on thumb 100*t* at the wide-open posture
125*p*. Stick mark left by a bottom chopstick on purlicue 100*p* at the wide-open posture
133*t*. Stick mark left by a top chopstick on thumb 100*t* at the closed posture
133*i*. Stick mark left by a top chopstick on index finger 100*i* at the closed posture
133*m*. Stick mark left by a top chopstick on middle finger 100*m* at the closed posture
134*r*. Stick mark left by a bottom chopstick on ring finger 100*r* at the closed posture
135*t*. Stick mark left by a bottom chopstick on thumb 100*t* at the closed posture
135*p*. Stick mark left by a bottom chopstick on purlicue 100*p* at the closed posture
163*t*. Stickprint by a top chopstick on thumb 100*t*, complementing fingerprint 63
163*i*. Stickprint by a top chopstick on index finger 100*i* complementing fingerprint 63
163*m*. Stickprint by a top chopstick on middle finger 100*m* complementing fingerprint 63
164*r*. Stickprint by a bottom chopstick on ring finger 100*r*, complementing fingerprint 64
165*t*. Stickprint by a bottom chopstick on thumb 100*t*, complementing fingerprint 65
165*p*. Stickprint by a bottom chopstick on purlicue 100*p*, complementing fingerprint 65
211*t*. Planet gear representing the thumb operating on top chopstick 20
211*i*. Planet gear representing the index finger operating on top chopstick 20
213*t*. Planet gear representing the base of the thumb operating on bottom chopstick 30
214*m*. Planet gear representing the middle finger operating on top chopstick 20
214*r*. Planet gear representing the ring finger operating on bottom chopstick 30
220. Sun gear representing top chopstick 20 in a planetary gear train
230. Sun gear representing bottom chopstick 30 in a planetary gear train
241. Right face of top chopstick 20
242. Top face of top chopstick 20
243. Left face of top chopstick 20
244. Bottom face of top chopstick 20
313*d*. Displacement direction of bottom chopstick 30 caused by thumb base 113*t*
314*d*. Displacement direction of bottom chopstick 30 caused by distal knuckle 114*t*
351. Right face of bottom chopstick 30
352. Top face of bottom chopstick 30
353. Left face of bottom chopstick 30
354. Bottom face of bottom chopstick 30

DETAILED DESCRIPTION OF THE INVENTION

First Embodiment of Ergonomic Chopsticks

Figure 1C:
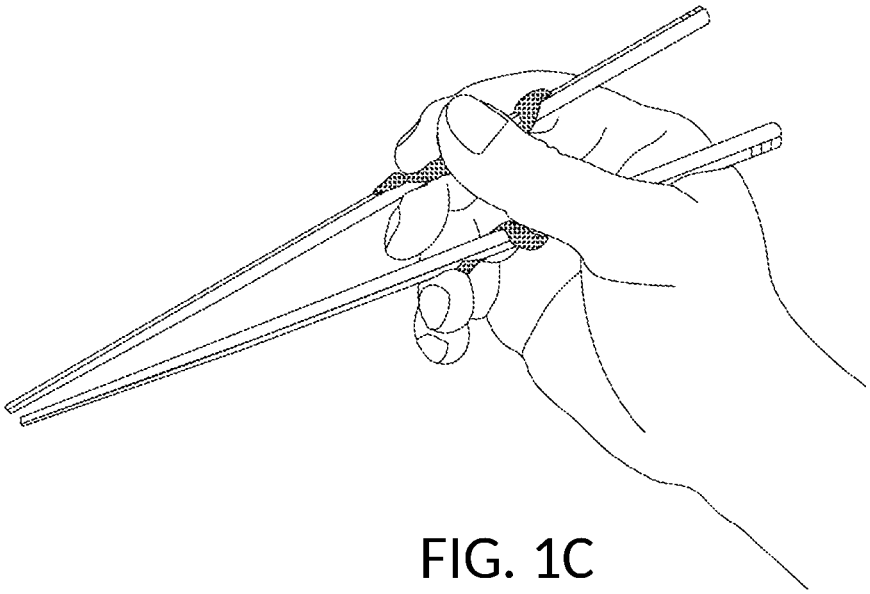
FIG. 1C is a view of the right hand holding the embodiment of ergonomic chopsticks, from 1W, now at the closed end of the standard grip and motion, where the tips of the chopsticks touch.

FIG. 1W and FIG. 1C illustrate the first embodiment of ergonomic chopsticks being wielded by a human hand. As described previously, ergonomic chopsticks assist users in learning the standard grip, while preserving the same finger dynamics used with plain chopsticks. Achieving both goals was not a straightforward task in the past, when the planetary gear-like nature of the standard grip motion was not understood. Now that the twirling of the chopsticks by fingers is uncovered, it is possible to design low-profile protrusions to be mounted on plain chopsticks, such that they skirt surface areas of chopsticks where fingers grip and twirl chopsticks throughout the alternating motion. These strategically-placed protrusions are called "ergonomic nuggets", and they are shown shaded in FIG. 1W and FIG. 1C. The ergonomic nuggets provide tactile feedback to fingers, without interfering with the standard grip motion. Thus, both goals can now be achieved.

Figure 2W:
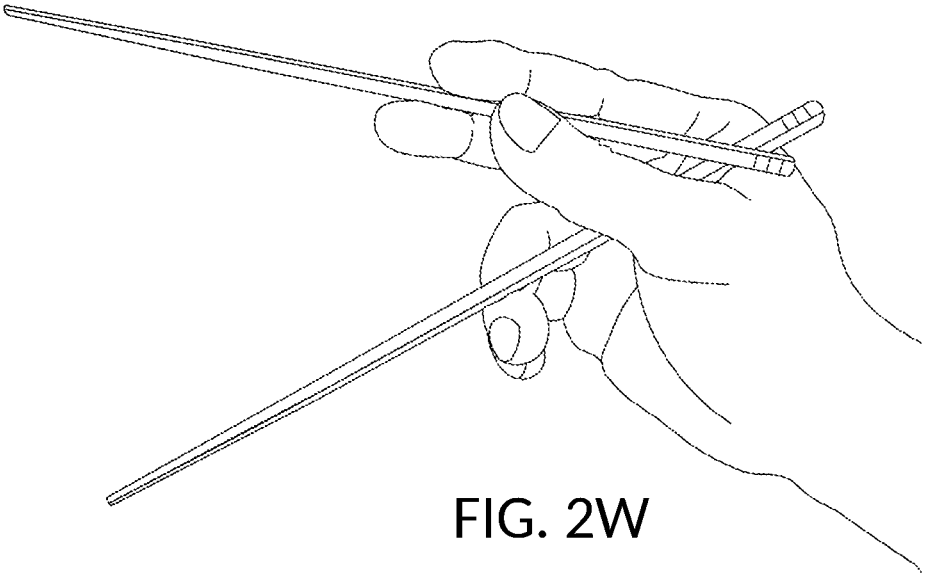
FIG. 2W is a view of a right hand holding a pair of plain chopsticks, at the wide-open end of the standard grip and motion, demonstrating that identical finger posture and chopstick manipulation are used, on plain chopsticks in this illustration, and on ergonomic chopsticks as shown in FIG. 1W.
Figure 2C:
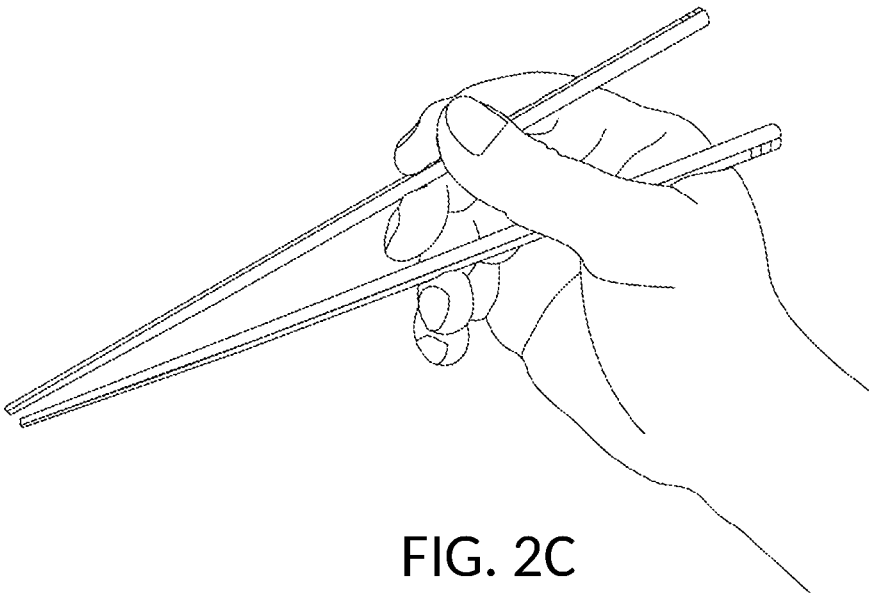
FIG. 2C is a view of the right hand holding the plain chopsticks from 2W, now at the closed end of the standard grip and motion, demonstrating that identical finger posture and chopstick manipulation continue to be used, on plain chopsticks in this illustration, and on ergonomic chopsticks as shown in FIG. 1C.

FIG. 2W and FIG. 2C illustrate the same human hand wielding a pair of plain chopsticks. By comparing these to FIG. 1W and FIG. 1C, one can ascertain the non-intrusiveness of these ergonomic nuggets.

Standard Grip and Alternating Motion

The "standard grip" allows the human hand to spread tips of the two chopsticks apart, such that these two chopsticks form an angle equal to or greater than 40 degrees, as illustrated in the "wide-open posture" in FIG. 1W and FIG. 2W. In the "closed posture" of the standard grip, the two tips touch or almost touch, and the rear ends of the two chopsticks are extended apart, as illustrated in FIG. 1C and FIG. 2C. The "alternating motion" of the standard grip denotes sequences of movements of fingers manipulating chopsticks back and forth, between the wide-open posture and the closed posture.

Unrestricted Chopsticks

A pair of chopsticks is considered "unrestricted", when a user of the standard grip can achieve the full range of motions as described above, with said pair, as they can with a pair of plain chopsticks. In other words, unrestricted chopsticks allow users to wield them in the same way as they wield plain chopsticks. Unrestricted chopsticks preserve the finger-to-chopstick contact experience as delivered by plain chopsticks, throughout the alternating motion. The plain chopsticks in FIG. 2W and FIG. 2C are by definition unrestricted chopsticks.

The first embodiment of ergonomic chopsticks shown in FIG. 1W and FIG. 1C are also unrestricted chopsticks, even as they provide additional tactile feedback to fingers. This embodiment allows the same full range of motion as plain chopsticks. It operates exactly like plain chopsticks, and thus delivers the same mechanical advantages, while enhancing the ability of the user to achieve proper and desired finger movements. The ergonomic nuggets do not come between fingers and chopstick surfaces that these fingers grip, at any time during the alternating motion. They allow fingers to experience the same chopstick contacts, and to manipulate these chopsticks with the same standard grip dynamics.

Fingers and Plain Chopsticks

Figure 3A:
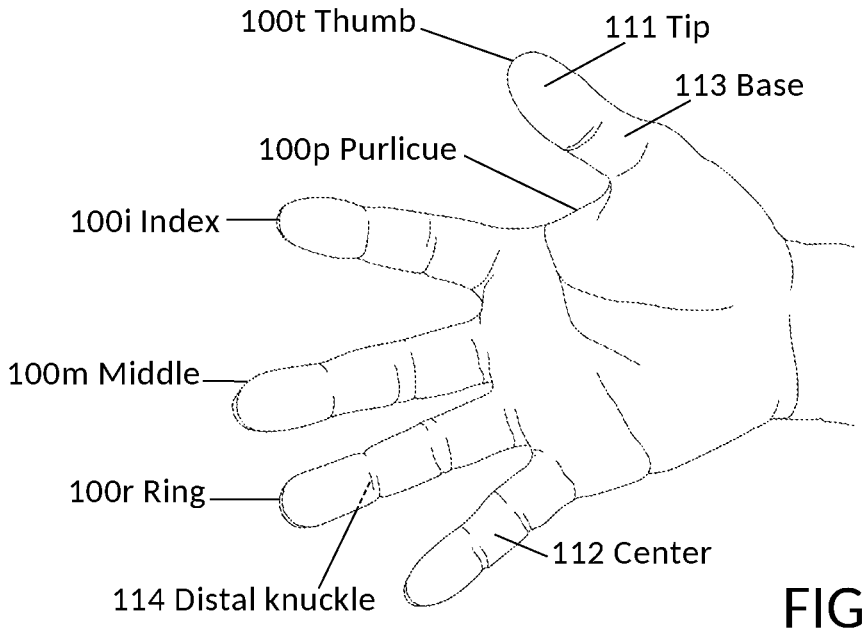
FIG. 3A is a view of the right hand from 2W, now with the palm open and all 5 fingers extended, illustrating the location of the purlicue, and identifying parts of fingers.

A medium-size adult right hand is shown in FIG. 3A, and is used throughout this disclosure. However, a left hand will also work—ergonomic chopsticks can be mirrored for a left hand. Four fingers are involved in manipulating chopsticks. They are: thumb 100*t*, index finger 100*i*, middle finger 100*m*, and ring finger 100*r*. The web between thumb 100*t* and index finger 100*i* is purlicue 100*p*; it is instrumental in holding the bottom chopstick. Personal preference determines how far back along the top chopstick a user places thumb 100*t*. As a result, purlicue 100*p* may or may not contact the top chopstick during the alternating motion.

The distal segment of a finger is a tip segment 111. The segment connecting a finger to the palm is a base segment 113. The segment in between is a center segment 112. The thumb is the only finger without a center segment. In addition, the knuckle between a tip segment and a center segment is a distal knuckle 114.

Figure 3B:
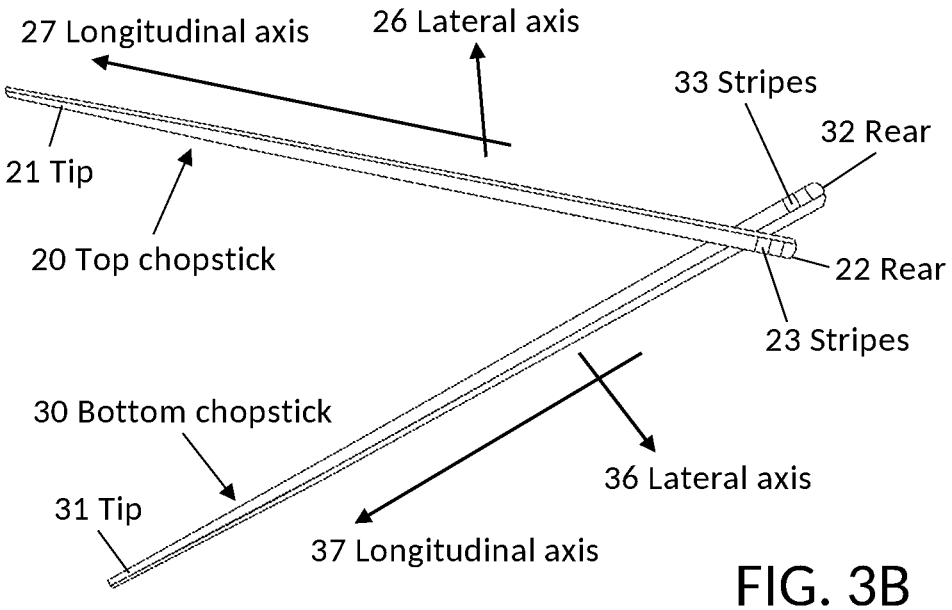
FIG. 3B annotates components of the plain chopsticks from 2W, and identifies the lateral axis and the longitudinal axis of each chopstick.

A pair of "plain" chopsticks consists of a top chopstick 20 and a bottom chopstick 30. An example is shown in FIG. 3B. For this illustration, typical Japanese square chopsticks are used. These have a square cross section, thus the name. These chopsticks measure 9 inches, or 23 cm, long. Many other types of chopsticks are also plain chopsticks, as described elsewhere in this disclosure. Tips 21 and 31 are parts of chopsticks 20 and 30 for picking up food. Tips of chopsticks are usually tapered. The rear ends are labeled 22 and 32. Stripe marks 23 and 33 are shown in drawings of chopsticks 20 and 30, only for illustration purposes. They allow readers to track faces of chopsticks, between drawings of the wide-open posture and the closed posture.

Lateral axis 26 and longitudinal axis 27 of top chopstick 20 are illustrated in FIG. 3B. Top chopstick 20 extends and flexes around its lateral axis 26, and rolls around its longitudinal axis 27. The extension and the flexion of the top chopstick are the main contributors to the opening and closing of chopstick tips in the standard grip. The bottom chopstick contributes significantly less. However, as will be discussed, the bottom chopstick 30 also extends and flexes around its lateral axis 36, and rolls around its longitudinal axis 37.

Ergonomic Nuggets

As stated earlier, ergonomic chopsticks are unrestricted chopsticks. Ergonomic chopsticks are wielded by proficient users of the standard grip, in exactly the same way they wield plain chopsticks. These ergonomic chopsticks, however, go one step further—they guide beginners and lifelong chopstick users alike to learn and to adopt the standard grip.

Figure 4W:
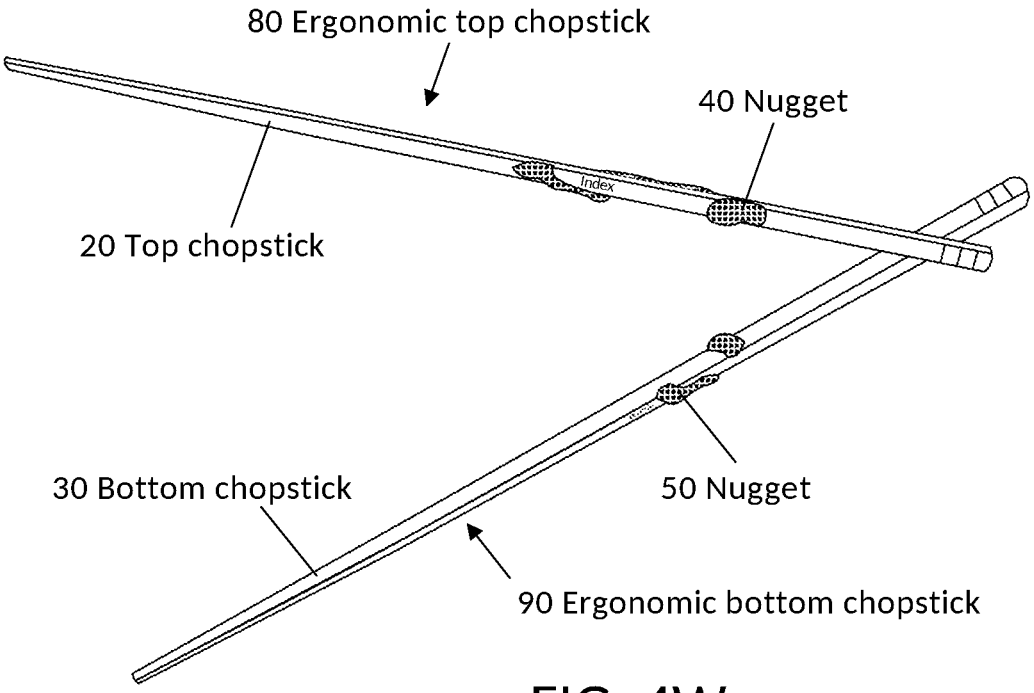
FIG. 4W is a view of the ergonomic chopsticks from FIG. 1W at the wide-open posture, without the right hand, showing two contiguous, low-profile nuggets mounted on two plain chopsticks.
Figure 4C:
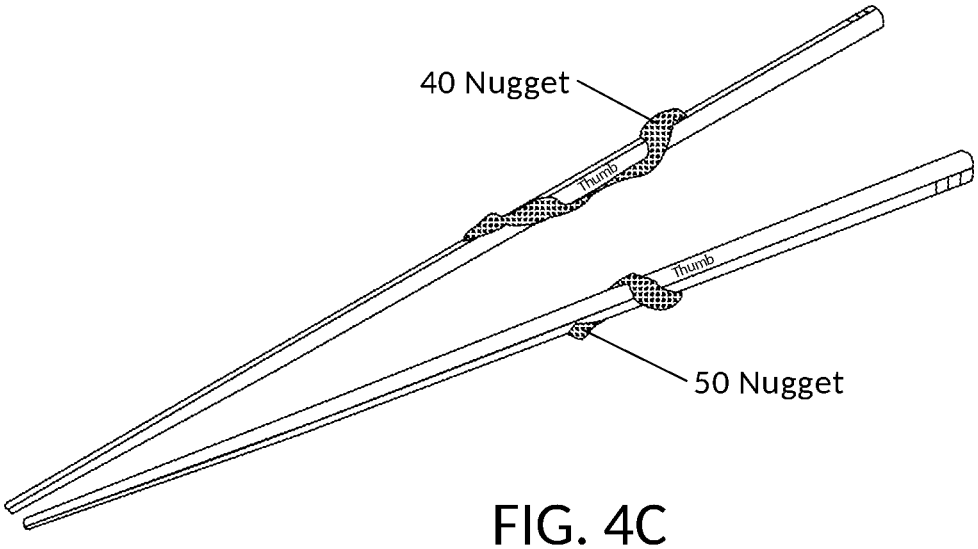
FIG. 4C is a view of the ergonomic chopsticks from FIG. 1C at the closed posture, without the right hand, showing two contiguous, low-profile nuggets mounted on two plain chopsticks.

To illustrate this, FIG. 4W and FIG. 4C show the first embodiment from FIG. 1W and FIG. 1C, with the human hand removed. Ergonomic nuggets are placed outside of chopstick surfaces that fingers grip, to avoid interfering in the alternative motion. At the same time, portions of these nuggets are strategically located to generate gentle feedback to fingers, to signal the two ends of the alternating motion. Wherever possible, continued tactile feedback throughout the alternating motion is also generated to help users avoid deviating from the standard grip.

In the first embodiment shown in FIG. 4W, all protrusions on each chopstick are connected to form a contiguous, low-profile nugget body with discernible nugget portions. Thus, there is only one top ergonomic nugget 40 mounted on plain chopstick 20. The combination results in ergonomic top chopstick 80. Similarly, there is only one bottom ergonomic nugget 50 mounted on plain chopstick 30. This combination results in ergonomic bottom chopstick 90.

Structure of the Top Nugget

Figure 5B:
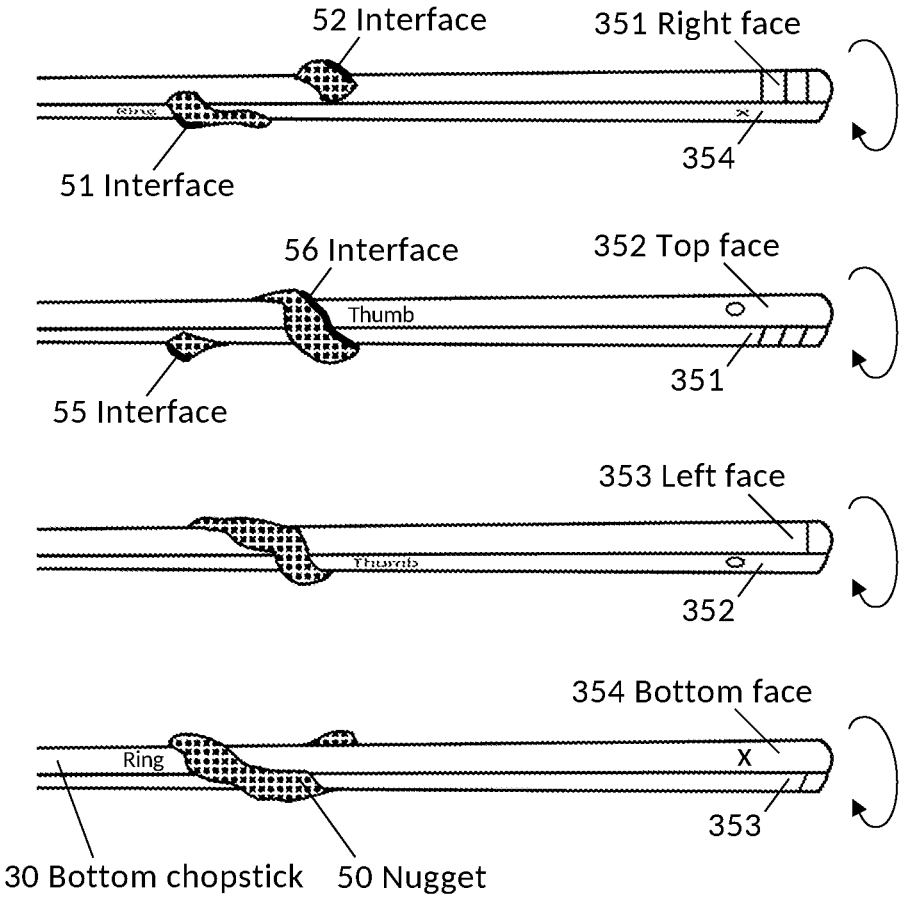
FIG. 5B shows four faces of the ergonomic bottom chopstick from FIG. 1C, with the hand removed, such that the geometry of the contiguous nugget body can be described, that all inscribed finger labels can be read, for initial placement at the closed posture, and that all contact interfaces on nugget surfaces can be shown to be located between nugget portions and finger labels.
Figure 5T:
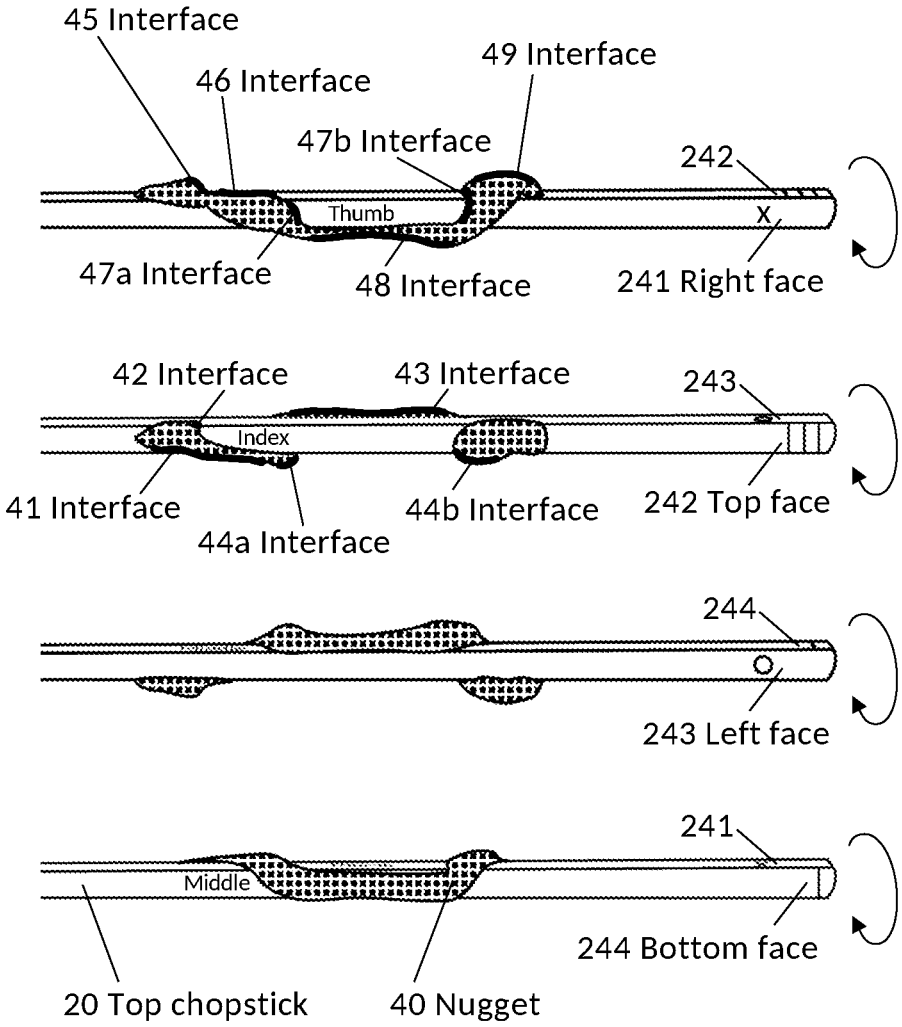
FIG. 5T shows four faces of the ergonomic top chopstick from FIG. 1C, with the hand removed, such that the geometry of the contiguous nugget body can be described, that all inscribed finger labels can be read, for initial placement at the closed posture, and that all contact interfaces on nugget surfaces can be shown to be located between nugget portions and finger labels.

FIG. 5T shows four faces of the ergonomic top chopstick from FIG. 4W and FIG. 4C, such that the structure of top nugget 40 can be clearly discerned. Top chopstick 20 is rolled at increments of 90 degrees clockwise, looking down the tip towards the rear. Illustrative markings on the rear end identify right face 241, top face 242, left face 243, and bottom face 244. Labels "Thumb", "Index" and "Middle" are inscribed on top chopstick 20, respectively at "thumb space", "index space" and "middle space". These spaces identify chopstick surfaces corralled by nugget portions which receive the named fingers, at the initial closed posture.

The thumb space on right face 241 serves as an anchor for other finger spaces on top nugget 40. In a proper standard grip, the tip segment of the thumb covers this space in the closed posture. The index space is located on top face 242, forward of the thumb space, to be covered by the tip segment of the index finger. The middle space is located on bottom face 244, roughly aligned with the index space, to be covered by the distal knuckle of the middle finger.

Top nugget 40 in FIG. 5T starts with a first nugget portion on top face 242 of chopstick 20, forward of the index space. It extends rearward in a clockwise spiral until it reaches the thumb space on right face 241. It continues to spiral downward on the right face, with a second nugget portion hugging the thumb space. As it reaches bottom face 244, it clears the middle space on the bottom face. Then the spiral stops, and a third nugget portion now extends rearward in a straight line on the bottom face, for a length equal to the width of the thumb finger. After that, the nugget body wraps around top chopstick 20 counterclockwise upward and rearward on right face 241, with a fourth nugget portion hugging the thumb space. When the spiral reaches top face 242, it straightens and extends rearward on the top face briefly, before it ends.

Top nugget 40 looks like a squashed U-shape with serif, when seen from right face 241. It doesn't cover any part of left face 243. When seen from the left face, top nugget 40 looks like a clip—it sandwiches chopstick 20 from top face 242 and bottom face 244.

FIG. 5T also identifies various "contact interfaces" located on surfaces of portions of nugget 40. Ergonomic nuggets generate feedback to fingers via these interfaces. The first nugget portion on top face 242 provides interface 41, interface 42, and interface 45. The second nugget portion on right face 241 provides interface 44*a*, interface 46, and interface 47*a*. The third nugget portion on bottom face 244 provides interface 43 and interface 48. Lastly, the fourth nugget portion on right face 241 provides interface 44*b*, interface 47*b* and interface 49. Purposes of these interfaces will be described later in the disclosure.

Structure of the Bottom Nugget

FIG. 5B shows four faces of the ergonomic bottom chopstick from FIG. 4W and FIG. 4C, such that the structure of bottom nugget 50 can be clearly discerned. Bottom chopstick 30 is rolled at increments of 90 degrees clockwise, looking down the tip towards the rear. Illustrative markings on the rear end identify right face 351, top face 352, left face 353, and bottom face 354. Labels "Thumb" and "Ring" are inscribed on bottom chopstick 30, respectively at "thumb space" and "ring space". These spaces identify chopstick surfaces corralled by nugget portions which receive the named fingers, at the initial closed posture.

The thumb space on top face 352 is covered by the base segment of the thumb, at the initial closed posture. The thumb space serves as an anchor for the ring space, which is covered by the distal knuckle of the ring finger, at initial placement. The ring space is located on bottom face 354, forward of the thumb space. The ring space and the thumb space are offset longitudinally for a distance equal to the width of the thumb base.

Bottom nugget 50 in FIG. 5B starts at the border between right face 351 and bottom face 354, aligned longitudinally with the end of the ring space. The nugget body generally wraps around chopstick 30 in a clockwise spiral towards the rear end. The spiral includes a first nugget portion on bottom face 354, behind the ring space. The spiral continues, with a second nugget portion forward of the thumb space on top face 352. The spiral lasts a total of one revolution, and ends on right face 351, overlapping longitudinally with the thumb space.

Bottom nugget 50 is shaped as a spiral to match the natural contours and orientations of the thumb and the ring finger, in the standard grip configuration. The spiral surfaces of bottom nugget 50 help the thumb and the ring finger to assume proper initial positions, at correct angles and orientations with respect to each other.

FIG. 5B also identifies some contact interfaces located on portions of nugget 50. The first portion of the nugget provides interface 51 and interface 55. The second portion of the nugget provides interface 52 and interface 56. Purposes of these contact interfaces will now be described in details.

Contact Interfaces at the Wide-Open Posture

Figure 6W:
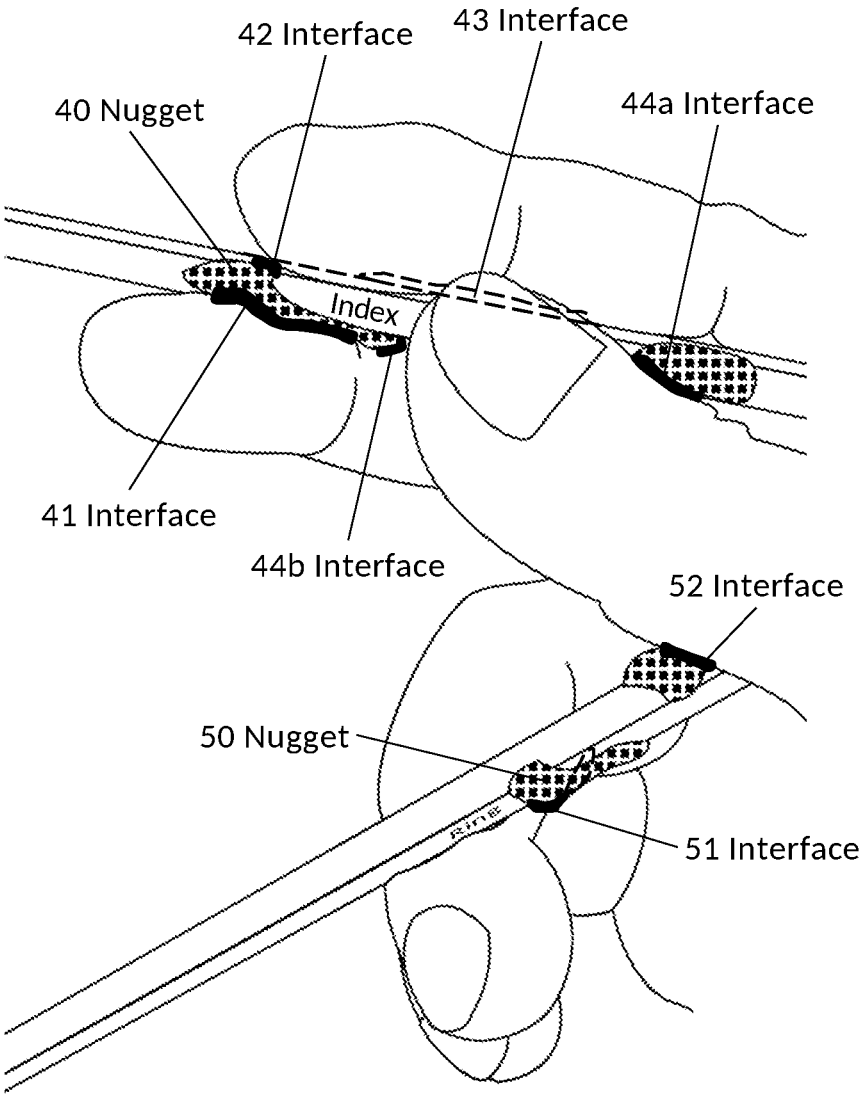
FIG. 6W is a detailed view of ergonomic nuggets and human fingers from FIG. 1W at the wide-open posture, showing how the strategically-placed nugget portions provide feedback via contact interfaces to fingers, in order to cap the roll of the top chopstick at the wide-open end of the alternating movement, to guide the thumb and the ring finger as they roll the bottom chopstick, and to prevent the two chopsticks from slipping out of position along their own respective longitudinal axes.

FIG. 6W illustrates how ergonomic nuggets provide tactile feedback to fingers at the wide-open end of the alternating motion. The feedback is generated by surfaces of nuggets known as "contact interfaces". These interfaces come into contact with surfaces of fingers that are not involved in twirling chopsticks, generating gentle feedback serving a variety of purposes.

ROLL LIMIT. Top nugget 40 in FIG. 6W caps the roll of the top chopstick at the wide-open posture, using contact interfaces 41, 42, 43, 44*a* and 44*b*. These are "wide-open-limit interfaces"—they mark the limit of the roll at the wide-open end of the alternating motion. These interfaces make contact with the middle finger, the index finger and the thumb. Interface 41 abuts the middle finger at the end of the roll. Interfaces 42 and 43 abut the index finger, with the interface 43 being shown with hidden lines, as it is on the bottom face of the chopstick. Interfaces 44*a* and 44*b* abut the thumb. Interface 43 is large enough to serve as a physical obstruction, to enforce the wide-open roll limit.

ROLL GUIDE. Bottom nugget 50 in FIG. 6W guides the ring finger and the base of the thumb, as these fingers roll the bottom chopstick, ending with interfaces 51 and 52 being in contact with these fingers at the wide-open end of the roll. Contact interfaces 51 and 52 are just two areas of larger "roll-guide surfaces" on bottom nugget 50. These guide surfaces are continuously in contact with fingers throughout the roll.

SLIP LIMIT. Both nuggets provide surfaces to limit unwanted movement of each chopstick along its longitudinal axis. FIG. 6W shows that at the wide-open end of the roll, some wide-open-limit interfaces, specifically interfaces 41, 42, 44*a*, and 44*b*, double as physical obstructions to help the thumb, the index finger and the middle finger keep top nugget 40, and thus the top chopstick, longitudinally within range. Thus, interfaces 41, 42, 44*a*, and 44*b* are parts of the "slip-limit surfaces" on top nugget 40. On bottom nugget 50, the two roll-guide surfaces double as "slip-limit surfaces", with interface 51 and 52 being in contact with fingers at the wide-open end of the roll.

Stick Marks at the Wide-Open Posture

Some surface areas of fingers are used in gripping and twirling chopsticks. Contact interfaces are designed not to interfere with these finger surfaces. Instead, contact interfaces generally provide feedback at the perimeters of these finger surface areas.

Figure 7W:
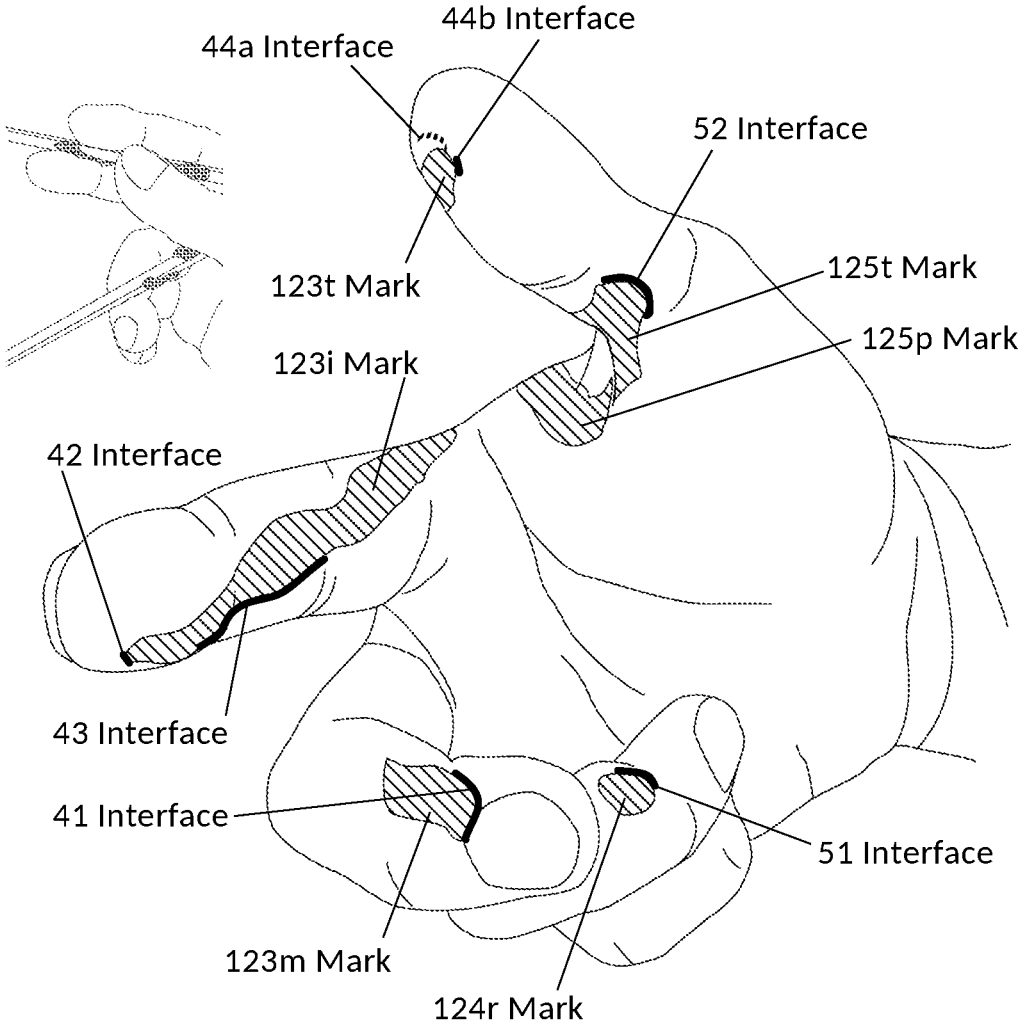
FIG. 7W is a view of stick marks left by ergonomic chopsticks from FIG. 6W on the thumb, the index finger, the purlicue, the middle finger, and the ring finger, at the wide-open posture, abutted by contact interfaces shown in FIG. 6W.

FIG. 7W identifies finger surfaces used in gripping and twirling chopsticks at the wide-open posture, as shaded areas. These are called "stick marks", for they are marks left by chopsticks on surfaces of fingers and the purlicue, as a result of the gripping. Stick marks 123*t*, 123*i* and 123*m* identify areas where the top chopstick contacts the thumb, the index finger, and the middle finger, respectively, at the wide-open posture. The bottom chopstick similarly leaves stick marks on fingers and the purlicue. Marks 124*r*, 125*t* and 125*p* identify areas where the bottom chopstick contacts the ring finger, the thumb, and the purlicue, respectively, at the wide-open posture.

All contact interfaces from FIG. 6W are reproduced in FIG. 7W, shown in bold lines where these nugget surface areas contact finger skin. It can be seen that in FIG. 7W, interface 41 from the top nugget borders mark 123*m* on the middle finger, interfaces 42 and 43 border mark 123*i* on the index finger, and interfaces 44*a* and 44*b* border mark 123*t* on the thumb. Similarly, interface 51 from the bottom nugget borders mark 124*r* on the ring finger, and interface 52 borders mark 125*t* on the thumb. No contact interfaces border mark 125*p* on the purlicue in this embodiment. No contact interfaces intrude into any stick mark.

It is thus shown that contact interfaces are designed around pre-existing stick marks, in order to uphold a genuine standard grip experience. In this first embodiment, all contact interfaces border perimeters of stick marks at the wide-open posture.

Contact Interfaces at the Closed Posture

Figure 8C:
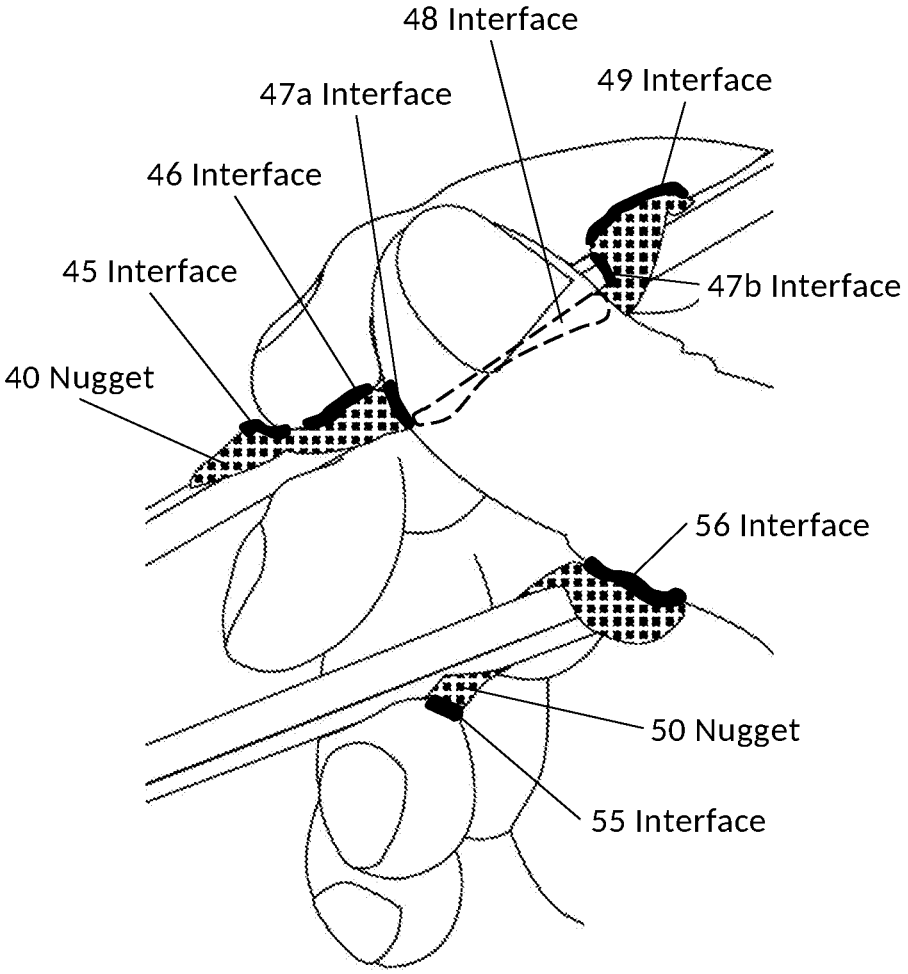
FIG. 8C is a detailed view of the ergonomic nuggets and human fingers from FIG. 1C at the closed posture, showing how the strategically-placed nugget portions provide feedback via contact interfaces to fingers, in order to cap the roll of the top chopstick at the end of the clamping movement, to guide the thumb and the ring finger as they roll the bottom chopstick, and to prevent the two chopsticks from slipping out of position along their own respective longitudinal axes.

FIG. 8C illustrates how ergonomic nuggets provide tactile feedback to fingers at the closed end of the alternating motion. Again, the feedback is generated by contact interfaces, for a variety of purposes.

ROLL LIMIT. Top nugget 40 in FIG. 8C caps the roll of the top chopstick at the closed posture, using contact interfaces 45, 46, 47*a*, 47*b*, 48, and 49. These are "closed-limit interfaces"—they mark the limit of the roll at the closed end of the alternating motion. These interfaces make contact with the index finger and the thumb. Interfaces 45, 46 and 49 abut the middle finger at the end of the roll. Interfaces 47*a*, 47*b* and 48 abut the thumb. Interface 48 is shown with hidden lines as it is obscured by the thumb. Interface 48 is large enough to serve as a physical obstruction, to enforce the closed roll limit.

ROLL GUIDE. The same "roll-guide surfaces" on bottom nugget 50 mentioned earlier from FIG. 6W continue to assist fingers as the roll comes to an end at the closed posture in FIG. 8C. But different contact interfaces 55 and 56 of these surfaces touch the ring finger and the thumb, respectively.

SLIP LIMIT. Similarly, the "slip-limit surfaces" mentioned from FIG. 6W continue to assist fingers in keeping the two chopsticks within proper position longitudinally, as the two chopsticks come to the end of their respective rolling motion at the closed posture. But different contact interfaces are in effect at this end of the rolling motion. FIG. 8C shows that some "closed-limit interfaces", specifically interfaces 45, 47*a*, and 47*b*, double as physical obstructions to help the thumb, the index finger and the middle finger keep top nugget 40, and thus the top chopstick, within range. On bottom nugget 50, the contact interfaces 55 and 56 from the roll-guide surfaces prevent longitudinal slips of the bottom chopstick, by being sandwiched between the ring finger and the thumb. These interfaces 45, 47*a*, 47*b*, 55, and 56 are parts of "slip-limit surfaces".

Stick Marks at the Closed Posture

At the closed end of the rolling motion, it can again be shown that all contact interfaces border perimeters of stick marks, and do not interfere with the manipulation of chopsticks by fingers.

Figure 9C:
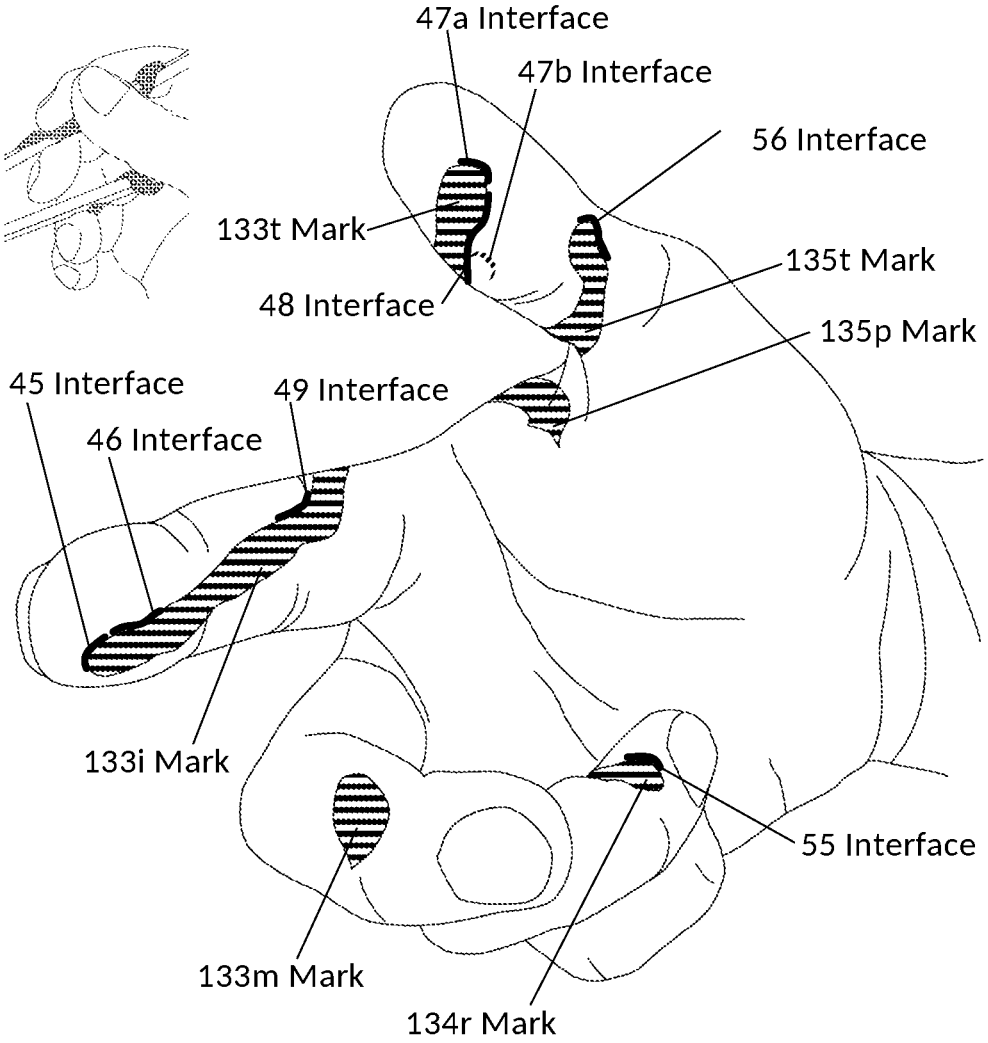
FIG. 9C is a view of stick marks left by ergonomic chopsticks from FIG. 8C on the thumb, the index finger, the purlicue, the middle finger, and the ring finger, at the closed posture, abutted by contact interfaces shown in FIG. 8C.

FIG. 9C identifies finger surfaces used in gripping and twirling chopsticks at the closed posture, as shaded stick marks. Stick marks 133*t*, 133*i* and 133*m* identify areas where the top chopstick contacts the thumb, the index finger, and the middle finger, respectively, at the closed posture. The bottom chopstick similarly leaves stick marks on fingers and the purlicue. Marks 134*r*, 135*t* and 135*p* identify areas where the bottom chopstick contacts the ring finger, the thumb, and the purlicue, respectively, at the closed posture.

All contact interfaces from FIG. 8C are reproduced in FIG. 9C, shown in bold lines where these nugget surface areas contact finger skin. It can be seen that in FIG. 9C, interfaces 45, 46 and 49 from the top nugget border mark 133*i* on the index finger, and interfaces 47*a*, 47*b* and 48 border mark 133*t* on the thumb. Similarly, interface 55 from the bottom nugget borders mark 134*r* on the ring finger, and interface 56 borders mark 135*t* on the thumb. No contact interfaces border mark 133*m* on the middle finger, nor mark 135*p* on the purlicue in this embodiment, at the closed posture.

Operation of Ergonomic Chopsticks

Figure 10T:
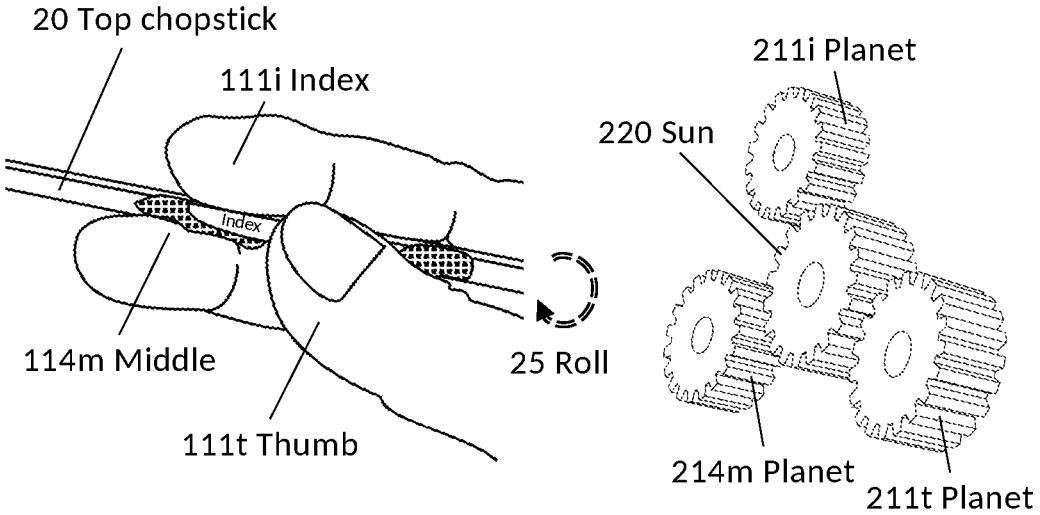
FIG. 10T compares the dynamics of three fingers manipulating the top chopstick (FIG. 10W), to that of a planetary gear train with three planet gears, shown without the outer gear ring.

As described earlier, ergonomic chopsticks comprise ergonomic nuggets and a pair of plain chopsticks, as illustrated for the first embodiment in FIG. 4W. Also as noted earlier, ergonomic chopsticks operate in exactly the same way as plain chopsticks, with portions of these ergonomic nuggets providing helpful tactile feedback, without interfering in the standard grip finger dynamics. That is, both ergonomic chopsticks and plain chopsticks are considered unrestricted chopsticks. Therefore, large parts of the forthcoming explanation of operation as shown in FIG. 10W and FIG. 10C apply to all unrestricted chopsticks. Operations common to both will be annotated as applicable to unrestricted chopsticks. Whenever ergonomic nuggets assist fingers with additional functionality, differences between operations on plain chopsticks and on ergonomic chopsticks will be specifically indicated.

Initial Chopstick Placement—Proficient Users

Generally, a proficient chopstick user can pick up a pair of unrestricted chopsticks from the table with a single hand, and sort the two chopsticks into a top chopstick and a bottom chopstick, using fingers from the same hand. Eventually the two chopsticks and all fingers settle into the correct, initial closed posture, as shown in FIGS. 1C and 1*n* FIG. 2C.

However, even proficient users find it difficult to place, single-handedly, fingers at the right positions along the longitudinal axis of each chopstick, without assistance from the other hand or some other object. Proficient users are able to assume the correct finger posture as shown in FIG. 2C, single-handedly, but many can't make the two chopsticks line up neatly with the two tips touching each other, without further assistance. Sometimes the fingers grip the two chopsticks too close to the rear of chopsticks, or too close to the tips. Recorded videos show that a majority of proficient users find ways to cope with this issue of longitudinal positioning, when using plain chopsticks. About ¼ of proficient users deploy the other hand to adjust chopstick offset, after assuming the standard grip posture. About ½ of proficient users pick up the two chopsticks from a table, and stand them on their tips on the table or a plate, so that the gripping hand may find the right offset to hold these two chopsticks. These adjustments are usually done subconsciously. Most users disclaim ever making such placement adjustments, until shown video recordings of them doing just that.

With the ergonomic chopsticks, there is no need to stand chopsticks on a potentially-unhygienic table to find the right gripping position. The aforementioned slip-limit surfaces help fingers find the right offset, single-handedly, as shown in FIG. 8C. Specifically, contact interfaces 45, 47*a*, and 47*b* on the top chopstick help the index finger and the thumb slide into, and lock onto the right longitudinal position. Contact interfaces 55 and 56 on the bottom chopstick help the ring finger and the base of the thumb to sandwich bottom nugget 50, and lock onto the right position.

Some users prefer a slight offset between the two tips of chopsticks. With the ergonomic chopsticks, such offset preference can be dialed in and locked down at the initial chopstick placement. Bottom nugget 50 in FIG. 8C is shaped as a spiral to match natural contours and orientations of the thumb and the ring finger. The spiral allows a user to adjust the starting position of the bottom chopstick along its longitudinal axis, by simply twisting the bottom chopstick. Thus, desired offset between the two tips along the longitudinal axes can be obtained. The adjustment is not limited to the initial placement—it can also be made as needed, during the course of a meal.

Initial Finger Posture—Beginners

A beginner needs to learn the correct finger posture for gripping unrestricted chopsticks, before they go on to master the manipulation of these chopsticks. One way to acquire a proper posture is to train on a single chopstick at a time. Start by picking up the top chopstick with three fingers, the thumb, the index finger and the ring finger. Position the top chopstick as illustrated in FIG. 2C, with the middle section of the chopstick sandwiched between the tip segment of the index finger, and the distal knuckle of the middle finger. Cover the chopstick with the tip segment of the thumb. Rest the rear end of the chopstick on the base of the index finger. Ignore the bottom chopstick at this stage. First learn to securely hold the top chopstick in this posture. In FIG. 2C, the right hand is used to grip the chopstick. Use the left hand to grab the tip of the chopstick, and attempt to pull the top chopstick away from the right hand. The three gripping fingers of the right hand should surround the chopstick and hold it firmly, to establish good friction and pressure, preventing the chopstick from being pulled away. The right hand, the fingers and the chopstick should not deviate from the closed posture, while resisting the pull. Now, use the left hand to try to wiggle the top chopstick away from the correct orientation. If the three fingers properly surround the chopstick in a planetary gear train fashion as discussed earlier, then the left hand cannot easily move the tip away.

While still holding the top chopsticks with the correct posture, use the left hand to insert the bottom chopstick, rear end first, into the gap between the base of the thumb and the purlicue. While tips of the chopsticks touch each other, rear ends of the top chopstick and the bottom chopstick should be spread apart, for at least the length of the base segment of the thumb, as illustrated in FIG. 2C. Without losing grip on the top chopstick, use the base of the thumb to press the bottom chopstick against the purlicue and against the distal knuckle of the ring finger. That is, the thumb, the ring finger, and the purlicue work together to clamp the bottom chopstick in place. Use the left hand to try to wiggle or pull the bottom chopstick away, to confirm that the bottom chopstick is properly gripped.

Note how the thumb does double duty. It is instrumental in gripping both the top chopstick and the bottom chopstick. It is the only finger providing pressure in a direction towards the palm, against all other fingers and the purlicue.

Ergonomic chopsticks makes learning the correct initial posture easier. Follow the same procedure outlined above, starting with just the top chopstick. Identify finger placement labels on the top chopstick (FIG. 5T). Place the thumb and the index finger on their respective labels, and the distal knuckle of the middle finger naturally slides into the space marked for it. This should result in the correct closed posture for the three fingers, as shown in FIG. 8C. Once the top chopstick is secured thus, insert the bottom chopstick, and have the base of the thumb cover the label bearing its name. The ring distal knuckle of the ring finger should slide naturally into position covering the label bearing its name.

After the first use of the ergonomic chopsticks, the labels will no longer be necessary. Top nugget 40 is shaped such that there is only one way to comfortably hold the top chopstick between the thumb, the index finger and the middle finger, depicted in FIG. 8C. The natural shape of the nugget should allow the three fingers to easily find their initial placements. Contact interfaces 45, 46, 47*a*, 47*b*, 48 and 49 on the nugget corral all segments of the index finger to lie on the top face of the chopstick, and the tip segment of the thumb to cover the right face of the chopstick. The distal knuckle of the middle finger naturally slides into position. The bottom nugget 50 on the bottom chopstick acts as a natural spacer between the base of the thumb and the distal knuckle of the ring finger. The spiral shape of nugget 50 acts as a guide for the thumb and the ring finger, forcing them to assume proper initial positions, at correct angles and orientations with respect to each other, assisted by contact interfaces 55 and 56.

Unlike many published devices, ergonomic chopsticks assist fingers in finding correct posture and placement without cutting into chopsticks, nor deforming chopsticks. This assistance is provided without compromising chopstick rolls and mechanical advantages. Refer to FIG. 5T and FIG. 5B to ascertain that spaces corralled by nugget portions are not simplistic fingertip-shaped holes. Such holes would only work at one posture, the initial closed posture. Strictly-finger-shaped holes would not allow fingers to twirl chopsticks, from the closed posture (FIG. 8C) to the wide-open posture (FIG. 6W). The seemingly irregularly-shaped ergonomic nuggets, on the other hand, allow fingers to roll out of their initial placement during twirling, thus enabling the planetary gear motion and its mechanical advantage.

Twirling the Top Chopstick

As I have observed, and as illustrated in FIG. 10W and FIG. 10C, top chopstick 20 needs to roll for 90 degrees back and forth, throughout the alternating motion of the standard grip, between the wide-open posture and the closed posture. This roll is a key enabler of the extension and the flexion of top chopstick 20. It allows top chopstick 20 to change its pitch angle, without a physical hinge or a fixed pivot.

While it appears that the thumb is always used as a fixed fulcrum in extension 24 (FIG. 10W) and in flexion 28 (FIG. 10C) of top chopstick 20, its primary function is not about being a fulcrum. In order to keep top chopstick 20 secure, the thumb has to clasp it, and press it along lateral axis 26 against both index finger and middle finger, pinning the chopstick in place. This pinning action is not conducive to the presumed function of the thumb as a hinge or a fixed pivot. If the thumb were used as a fixed pivot to change the pitch angle of top chopstick 20 without any rolling action 25 or 29, the pinning pressure would cause friction blisters on the thumb pulp, from repeated rubbing of sensitive finger skin across the chopstick surface.

Instead, when extending tip 21 outward, the top chopstick is twirled by the thumb, the index finger and the middle finger, resulting in both extension 24 and roll 25, as shown in FIG. 10W. When closing tip 21 inward against food items, the top chopstick is twirled the same way in reverse, resulting in both flexion 28 and roll 29, as shown in FIG. 10C. Throughout the twirling motion the thumb retains good surface contact with top chopstick 20 by pressing into it along its lateral axis 26 (FIG. 10W). Friction and unbroken contact enable the thumb to firmly roll chopstick 20 against the index finger and the middle finger. At no time does a chopstick surface rub against sensitive finger skin. Thus, the movement from the closed posture to the wide-open posture (FIG. 10W) is a flick of both index and middle fingers, assisted by the thumb and roll 25. The complementary movement back to the closed posture (FIG. 10C) involves the tip and the center segments of the index finger pulling top chopstick 20 downward, and the tip segment of the middle finger bending at the same rate to accommodate, assisted by the thumb and roll 29. The alternating motion of flicking and pulling of these two fingers resembles an "air quote".

This twirling mechanism can be understood, in terms of mechanical advantages, as a planetary gear train, also known as an epicyclic gear train. This is illustrated in FIG. 10T, which compares the three fingers holding the top chopstick to a planetary gear train. Top chopstick 20 is caged in by thumb tip 111*t*, index finger tip 111*i*, and the distal knuckle 114*m* of the middle finger. This is equivalent to a gear train where sun gear 220 is caged in by planet gears 211*t*, 211*i* and 214*m*. Friction ridges on fingers act like gear teeth, meshing with surfaces of the top chopstick. This is one reason why square chopsticks are more popular than chopsticks with a round cross section—the edges on square chopsticks are good gripping areas. This is also why people find chopsticks with a completely smooth surface especially hard to use—fingers cannot mesh securely to slippery surfaces.

In FIG. 10T, thumb tip 111*t* is the primary driver for the roll. The thumb skin meshes with the surface of the chopstick, and actively rolls the chopstick (e.g. roll 25). The outer gear ring which synchronizes planet gears in a planetary setup does not exist in physical forms here. The anatomy of the human hand and fingers is such that when a top chopstick is placed in the hand and between index finger tip 111*i* and middle finger knuckle 114*m*, in the standard grip, an air-quote gesture perfectly complements the active rolling action of the thumb. Skin of the index finger and the middle finger mesh with chopstick surfaces. Chopstick 20 rolls along skin surfaces of these two fingers as they perform the air quote illustrated in FIG. 10W and FIG. 10C. Recall that the air quote is responsible for extension 24 and flexion 28. This is why roll 25 and roll 29 are inseparable from extension 24 and flexion 28.

I have observed from my experiments that the classic Archimedean lever starts to play a role, only when much greater chopstick pressure is required than called for in normal eating situations. The thumb and the base of the index finger start to serve as moving pivots. To exert a tension force against an obstacle while extending tip 21 outward in FIG. 10W, the middle finger raises top chopstick 20, using the thumb and, to a lesser extent, the base of the index finger as moving pivots. To exert a compression force against an obstacle while closing tip 21 in FIG. 10C, the tip and the center segments of the index finger work in tandem to pull down top chopstick 20, using the base of the index finger as a moving pivot. In both cases, the thumb continues to assist these movements by pressing, rolling and twirling the chopstick, in the same way when little pressure was needed. Thus, rolls create moving pivots and prevent skin abrasion.

Twirling the Bottom Chopstick

Similarly, bottom chopstick 30 rolls for 90 degrees in both directions, as it extends tip 31 from the closed posture in FIG. 10C, to the wide-open posture in FIG. 10W, and then back. In normal eating situations, this is accomplished by the base of the thumb rolling bottom chopstick 30 in opposition to the ring finger. I have found that roll 35 and roll 39 around the longitudinal axis are inseparable from extension 34 and flexion 38 around the lateral axis. Specifically, when closing tip 21 and tip 31 in FIG. 10C, the thumb and the ring finger drag chopstick 30 in different directions, with the thumb dragging downward, and the ring finger dragging upward. This generates roll 39 and flexion 38 at the same time.

Figure 10B:
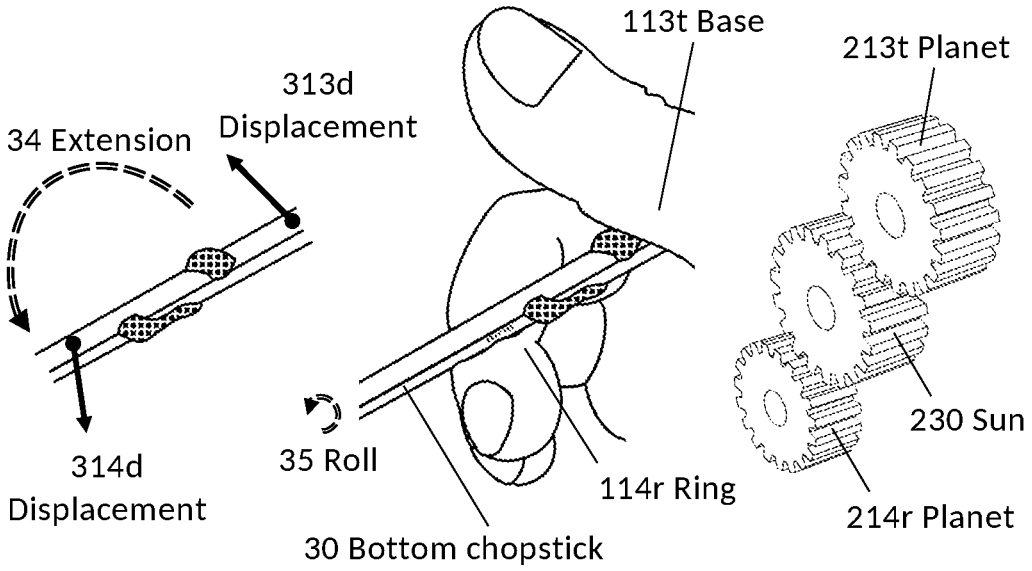
FIG. 10B compares the dynamics of two fingers manipulating the bottom chopstick (FIG. 10W), to that of a planetary gear train with two planet gears, shown without the outer gear ring.
Figure 10W:
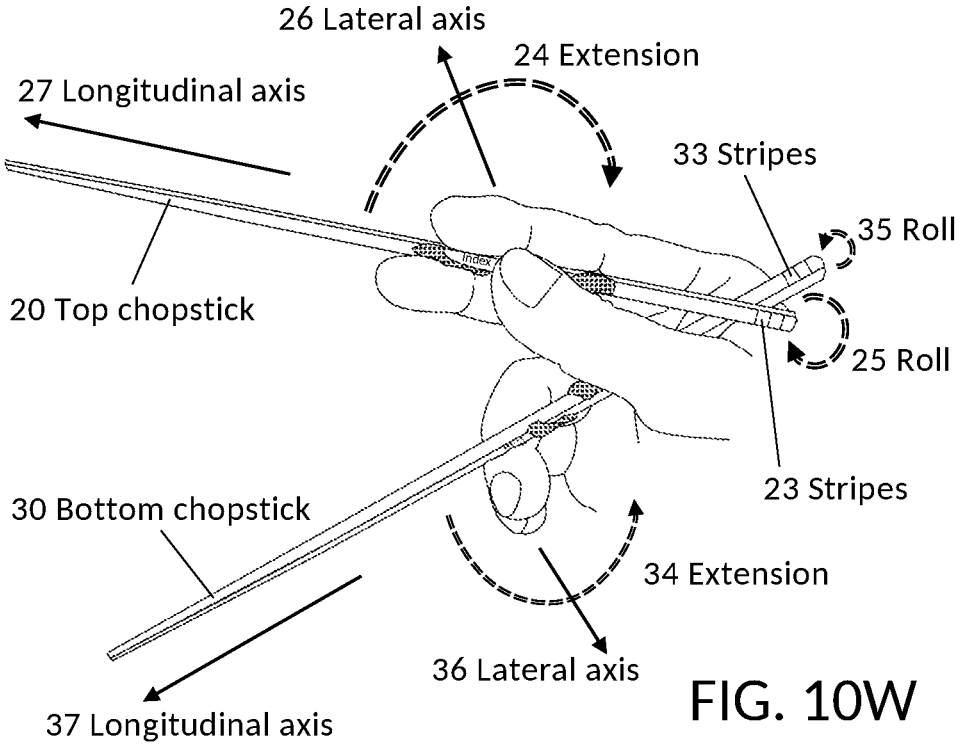
FIG. 10W is a view of extensions and rolls required, in order to bring the ergonomic chopsticks from the closed posture in FIG. 1C, to the wide-open posture in FIG. 1W, in the same way plain chopsticks from FIG. 2C and FIG. 2W are operated.
Figure 10C:
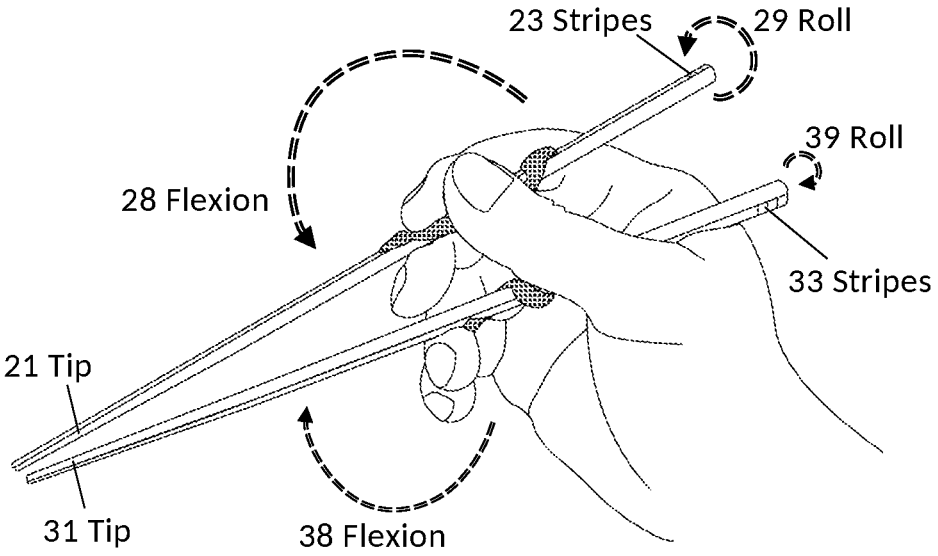
FIG. 10C is a view of flexions and rolls required, in order to bring the ergonomic chopsticks from the wide-open posture in FIG. 1W, to the closed posture in FIG. 1C, in the same way plain chopsticks from FIG. 2W and FIG. 2C are operated.

The coupling of rolls to extensions and flexions can again be explained by the principles of the planetary gear train, illustrated in FIG. 10B. In this case, bottom chopstick 30 is the equivalent of sun gear 230. Thumb base 113*t* and distal knuckle 114*r* of the ring finger are the equivalent of planet gears 213*t* and 214*r*, respectively. To extend tip of bottom chopsticks away from the top chopstick, thumb base 113*t* moves upward, while ring knuckle 114*r* moves downward. This drags bottom chopstick 30, causing displacements 313*d* and 314*d*, respectively. The result is extension 34 which tilts the bottom chopstick. But both the thumb and the ring finger must securely grip bottom chopstick 30 at all times, as discussed earlier about the initial finger posture. The meshing of skin to chopstick surfaces thus causes thumb base 113*t* and ring knuckle 114*r* to produce roll 35, as planet gears 213*t* and 214*r* would in a planetary gear train.

When unusually greater pressure is required to exert a tension force against an obstacle while extending tip 31 outward in FIG. 10W, then again, the classic Archimedean lever plays a role. The thumb pins bottom chopstick 30 along lateral axis 36 against both ring finger and the purlicue for a secure grip. And at the same time, the thumb also pushes chopstick 30 downward using the purlicue as a pivot, against the obstacle. The ring finger straightens out to accommodate the lever action, and ends up generating roll 35 of bottom chopstick 30 in opposition to the thumb, just like it does when little pressure is needed. The result is that the purlicue becomes a moving pivot. There are other possible ways for the thumb to exert tension forces on bottom chopstick 30 without involving roll 35, if the thumb did not also partake in moving top chopstick 20 simultaneously. But the thumb needs to manipulate both chopsticks at the same time. And the thumb can only secure both chopstick 20 and chopstick 30 by pinning both of them against other fingers and the purlicue. The roll 35 is a necessary consequence of the pinning action by the thumb.

To exert a large compression force against an obstacle while closing tip 31 in FIG. 10C, the ring finger raises bottom chopstick 30 using the base of the thumb as a moving pivot. The leverage results in roll 39, as tip 31 is raised by flexion 38, due to the angles at which the ring finger and the base of the thumb hug bottom chopstick 30. Again, there are other possible ways for the ring finger and the thumb to exert compression forces without involving roll 39, if the thumb did not also partake in moving top chopstick 20. But the thumb needs to do just that, thus the thumb-pinning, and thus roll 39.

Range of Alternating Motion

Figure 11T:
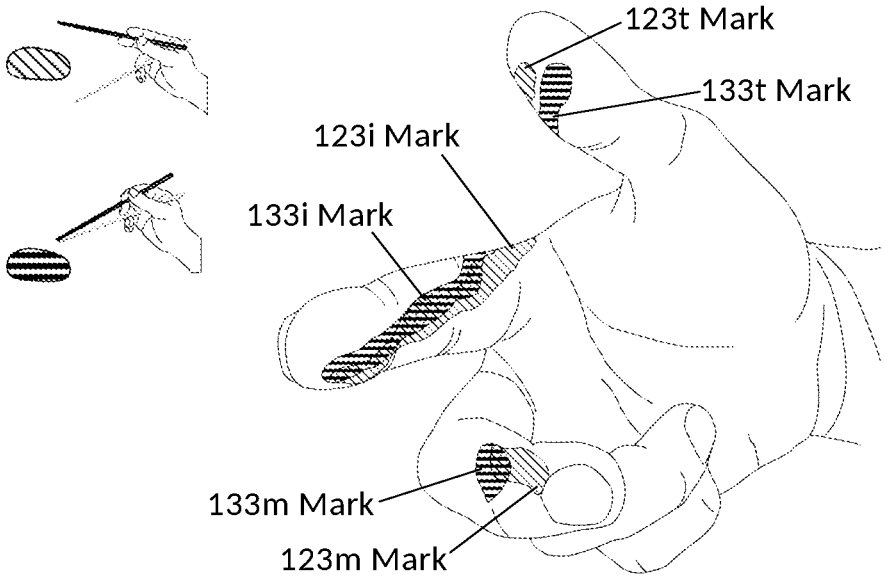
FIG. 11T is a view comparing stick marks left by the top chopstick on the thumb, the index finger, the middle finger, and the purlicue, at the two ends of the alternating motion—the wide-open posture from FIG. 7W, versus the closed posture from FIG. 9C, demonstrating the extent of the roll of the top chopstick in the alternating motion.

The dynamics of rolls, extensions and flexions can be further clarified by comparing marks left by chopsticks on fingers and the purlicue, at the two ends of the alternating motion. FIG. 11T illustrates stick marks made by the top chopstick, at these two ends, showing the range of the alternating motion. Marks 123*t*, 123*i*, and 123*m* identify areas where the top chopstick contacts the thumb, the index finger, and the middle finger, respectively, at the wide-open posture. Marks 133*t*, 133*i*, and 133*m* identify contacts at the closed posture. Mark 123*t* and mark 133*t* show how the top chopstick shifts from one posture to the other, clarifying the role of the tip segment of the thumb in rolling the top chopstick. The shift from mark 123*i* to mark 133*i* indicates both flexion 28 and roll 29 (FIG. 10C). The shift from mark 123*m* to mark 133*m* illustrates the effect of roll 29 on the middle finger. These shifts are evidences of the planetary gear train in action.

Figure 11B:
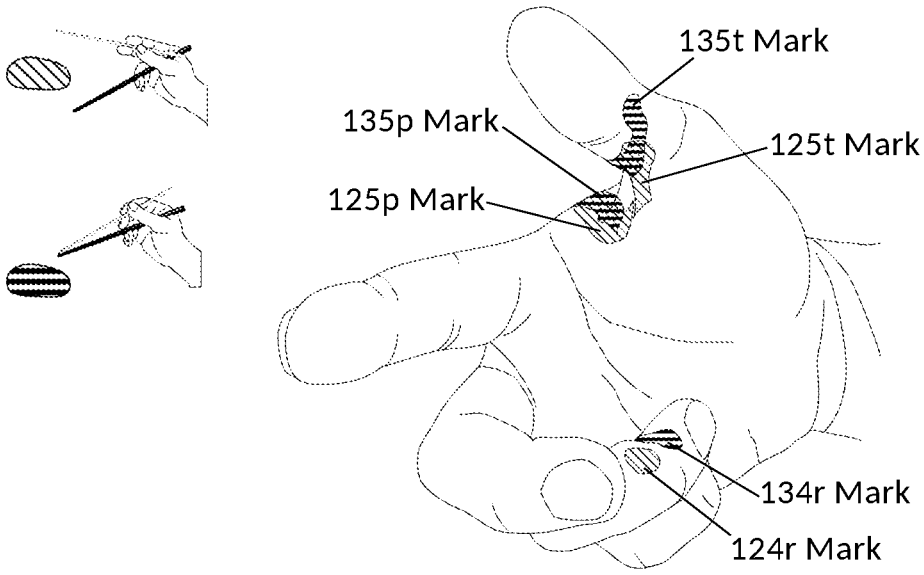
FIG. 11B is a view comparing stick marks left by the bottom chopstick on the thumb, the ring finger, and the purlicue, at the two ends of the alternating motion—the wide-open posture from FIG. 7W, versus the closed posture from FIG. 9C, demonstrating the extent of the roll of the bottom chopstick in the alternating motion.

The bottom chopstick similarly leaves stick marks on fingers and the purlicue, illustrated in FIG. 11B. Marks 124*r*, 125*t*, and 125*p* identify areas where the bottom chopstick contacts the ring finger, the thumb, and the purlicue, respectively, at the wide-open posture (FIG. 10W). Marks 134*r*, 135*t*, and 135*p* identify contacts at the closed posture (FIG. 10C). The shift from mark 124*r* to mark 134*r*, and the shift from mark 125*t* to mark 135*t* in the opposite direction illustrate the planetary gear train in action. Depending on personal preferences for how close to the rear end a user holds chopsticks, mark 125*p* and mark 135*p* will be slightly different.

Published literary and devices do not incorporate this insight on the range of the alternating motion. As a result, some are designed to work only for an unchanging grip represented by marks 133*t*, 133*i*, 133*m*, 134*r*, 135*t*, and 135*p* from the closed posture. They are made with the assumption that contacts between finger skins and chopstick surfaces remain unchanged throughout the use of chopsticks in eating situations. This is why these devices hinder or disable planetary gear dynamics of both top and bottom chopsticks.

Fingerprints

As fingers twirl a chopstick from one posture to another posture, different surfaces of fingers make contact with chopstick surfaces. In addition, the purlicue acts as a supporting surface for the bottom chopstick, so it is always in contact with the bottom chopstick. As for the top chopstick, the purlicue only brushes against the rear end of the top chopstick near the wide-open posture. The sum total of impressions by fingers and/or the purlicue on chopsticks forming a contiguous area throughout the alternating motion is referred to hereinafter as a "standard grip fingerprint", or simply "fingerprint" when the use is unambiguous.

Figure 12T:
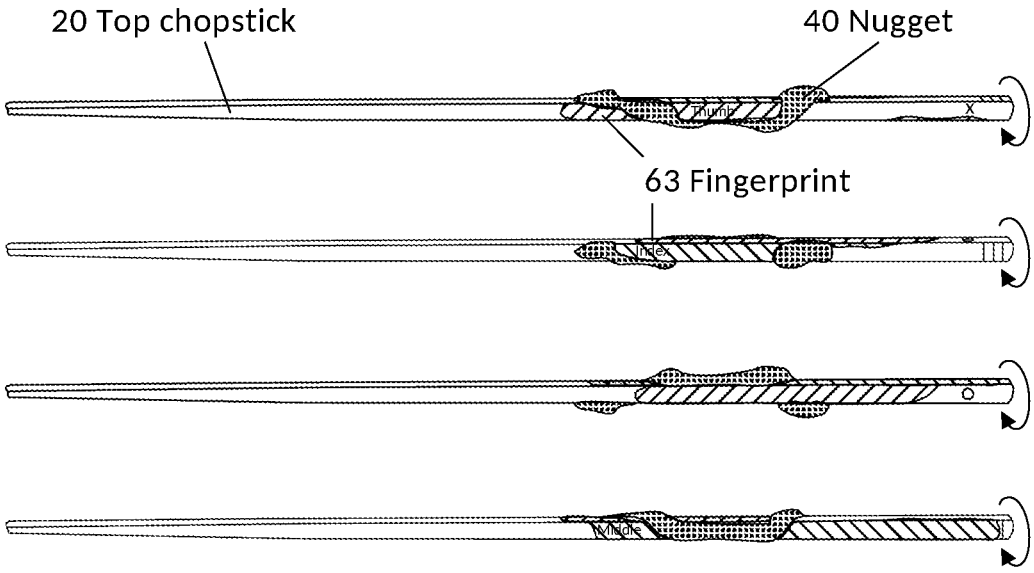
FIG. 12T shows four faces of the top ergonomic nugget from FIG. 5T, abutted by shaded surfaces representing accumulated finger impressions on the chopstick by the thumb, the index finger, the middle finger and the purlicue, between wide-open (FIG. 10W) and closed (FIG. 10C) postures, forming one contiguous fingerprint on the top chopstick.
Figure 12B:
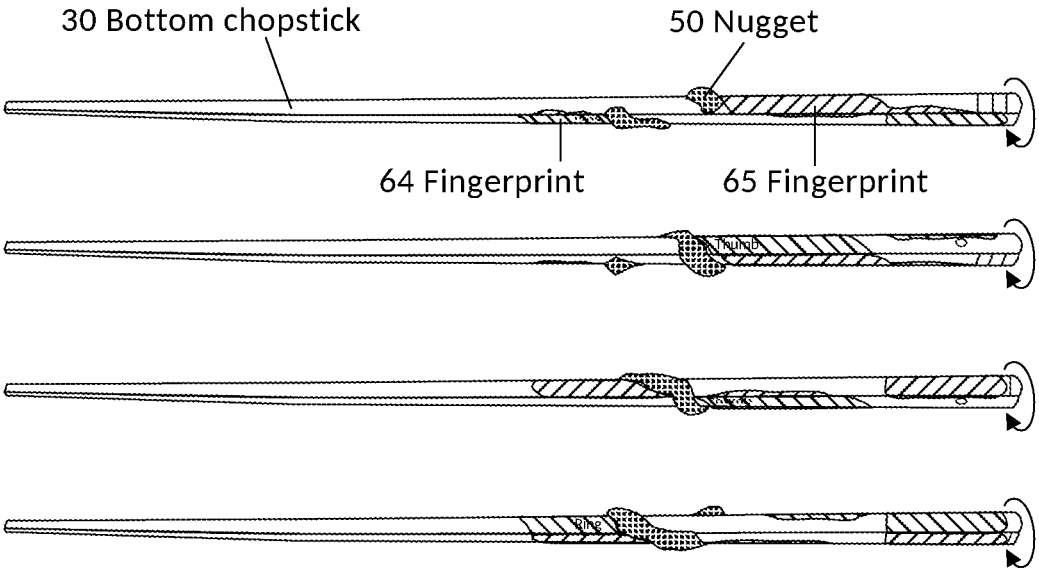
FIG. 12B shows four faces of the bottom ergonomic nugget from FIG. 5B, abutted by shaded surfaces representing accumulated finger impressions on the chopstick by the thumb, the ring finger and the purlicue, between wide-open (FIG. 10W) and closed (FIG. 10C) postures, forming two contiguous fingerprints on the bottom chopstick.

There are three distinct fingerprints in the standard grip. FIG. 12T and FIG. 12B illustrate these three fingerprints, and visually summarize the complementary nature of ergonomic nuggets and standard grip fingerprints, by showing how these accumulated finger impressions abut nugget portions.

All impressions left by the thumb, the index finger, the middle finger, and the purlicue on top chopstick 20 throughout the alternating motion are shown shaded with diagonal lines in FIG. 12T. All these contact surfaces are connected, and create one contiguous standard grip fingerprint 63, with an irregular shape. Ergonomic nugget 40 is shaped to border fingerprint 63, which can be thought of as a playground for fingers that twirl top chopstick 20.

Similarly, all impressions left by the ring finger, the thumb and the purlicue on bottom chopstick 30 are shown shaded in FIG. 12B. The ring finger leaves its own contiguous ring fingerprint 64. The thumb and the purlicue leaves another contiguous aft fingerprint 65. Ergonomic nugget 50 is shaped to border both ring fingerprint 64 and aft fingerprint 65. Again, these fingerprints can be thought of as playgrounds for fingers that twirl bottom chopstick 30.

Fingerprints vary based on choice of plain chopsticks, hand size, etc. Fingerprints are important in the design of ergonomic chopsticks, as will be shortly elaborated.

Stickprints

Figure 13T:
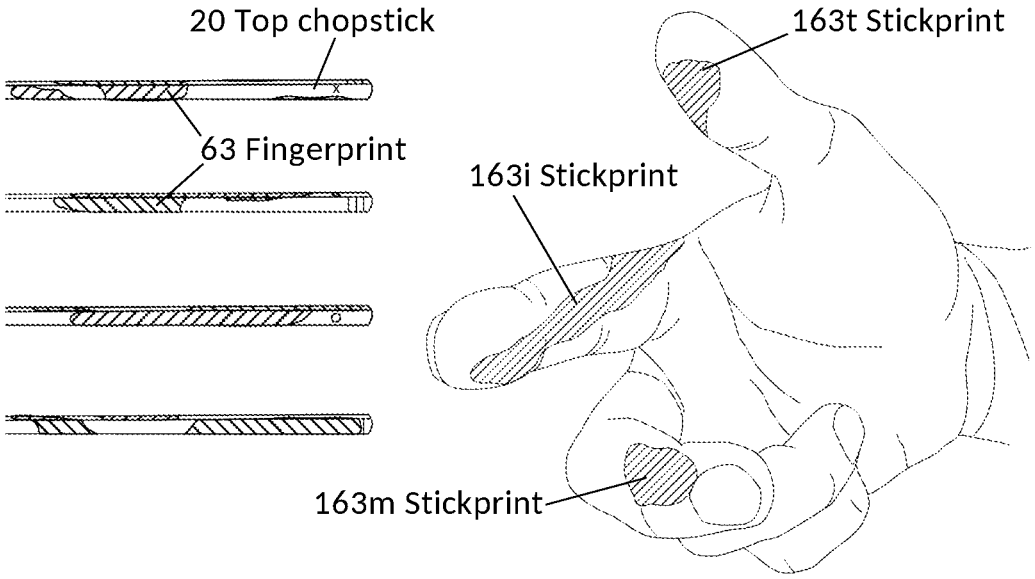
FIG. 13T is a view of stickprints made by the top chopstick on the thumb, the index finger, the middle finger, and the purlicue, throughout the alternating motion between the two end postures as the top chopstick extends, flexes and rolls (FIG. 10W and FIG. 10C), illustrating the complementary relationship between stickprints and the contiguous fingerprint from FIG. 12T.

The counterpart to a standard grip fingerprint on a chopstick is a "standard grip stickprint" on a finger. A fingerprint area is created from cumulative finger impressions, over the entire alternating motion. Its mirror stickprint area is created from cumulative stick marks on fingers, over the entire alternating motion. FIG. 13T shows three stickprint areas 163*t*, 163*i* and 163*m* made by top chopstick 20, on the thumb, the index finger and the middle finger, respectively. These are aggregated from all areas between 123*t*/133*t*, between 123*i*/133*i*, and between 123*m*/133*m*, from FIG. 11T. The three disjoint stickprints 163*t*, 163*i* and 163*m* are counterparts to a single contiguous fingerprint on top chopstick 20, the fingerprint 63 from FIG. 12T.

Figure 13B:
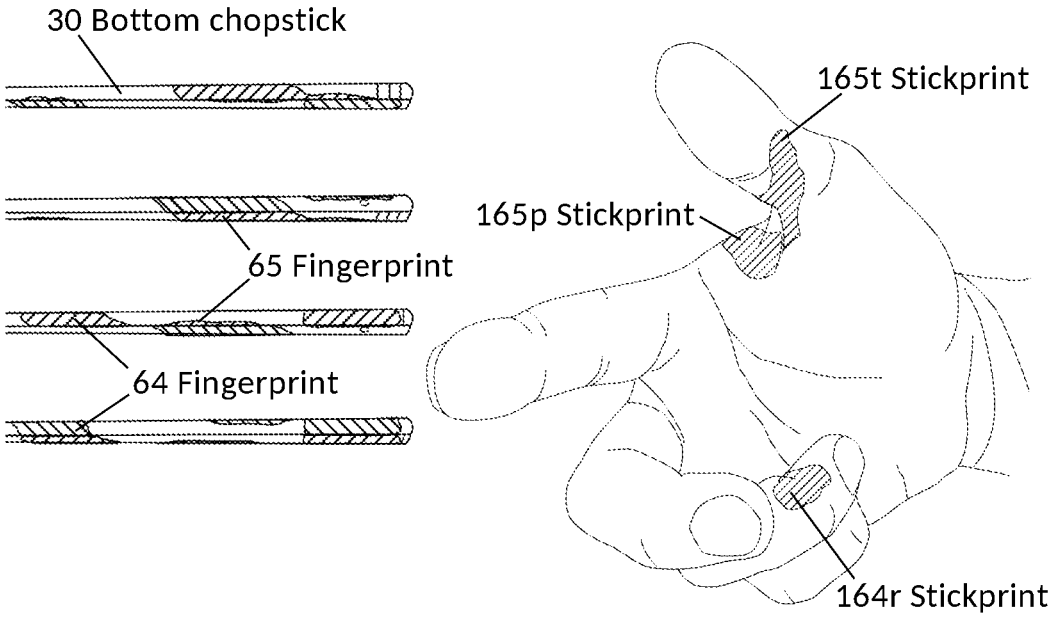
FIG. 13B is a view of stickprints made by the bottom chopstick on the thumb, the ring finger, and the purlicue, throughout the alternating motion between the two end postures as the bottom chopstick extends, flexes and rolls (FIG. 10W and FIG. 10C), illustrating the complementary relationship between stickprints and the two contiguous fingerprints from FIG. 12B.

Similarly, FIG. 13B shows three stickprint areas 164*r*, 165*t* and 165*p* made by bottom chopstick 30 on the ring finger, the thumb, and the purlicue, respectively. These are aggregated from all areas between 124*r*/134*r*, between 125*t*/135*t*, and between 125*p*/135*p*, from FIG. 11B. The stickprint 164*r* on the ring finger is the counterpart to fingerprint 64 from FIG. 12B. The stickprint 165*t* on the thumb actually borders stickprint 165*p* on the purlicue. They are labeled as distinct areas for clarity. These connected stickprints 165*t* and 165*p* are counterparts to fingerprint 65 from FIG. 12B.

Stickprints vary based on choice of plain chopsticks, hand size, etc. Stickprints, together with fingerprints, are key factors considered in the design of ergonomic chopsticks, as will be explained now.

Design Considerations

While there are many possible ways to design modified chopsticks to provide useful tactile feedback to fingers via protrusions or grooves, there are fewer ways to accomplish the same without modified parts intruding on the full range of finger motion of the standard grip. Any intrusion into the complex dynamics of chopstick wielding compromises mechanical advantages of the planetary gear train, and at the same time builds bad habits in users that are difficult to shed.

The first embodiment of ergonomic chopsticks, as unrestricted chopsticks, have all their ergonomic nuggets mounted outside the three fingerprints identified in FIG. 12T and FIG. 12B. This is a key constraint in the design of unrestricted chopsticks. It ensures that these modified parts (i.e. nugget portions) do not intrude on the operation of the planetary gear train. That is, nugget portions do not come between fingers and chopstick surfaces they twirl, at any time during the alternating motion. Furthermore, unrestricted chopsticks are not artificially coupled or otherwise structured in ways that prevent chopsticks from being manipulated like the sun gear in planetary gear trains. That is, wielding the first embodiment using the standard grip results in fingerprints identified in FIG. 14T and FIG. 14B. These considerations ensure that fingers experience the same chopstick contacts, and manipulate ergonomic chopsticks with the same standard grip dynamics. This constrain is known as the "preservation of fingerprints".

Figure 14B:
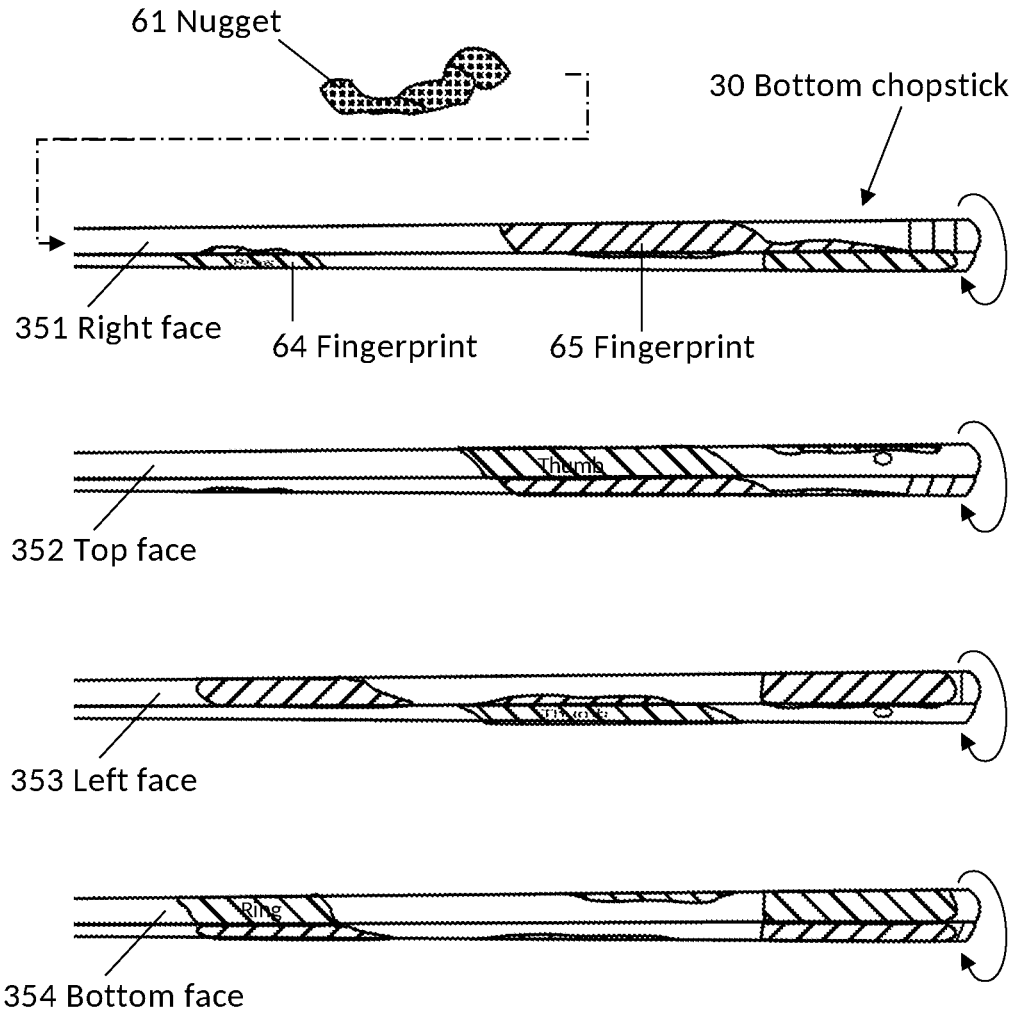
FIG. 14B is a view of the second embodiment of the present invention, where the bottom ergonomic nugget is a removable attachment to a plain bottom chopstick, demonstrating that the two contiguous fingerprints on the plain bottom chopstick are identical to those from the first embodiment shown in FIG. 12B.
Figure 14T:
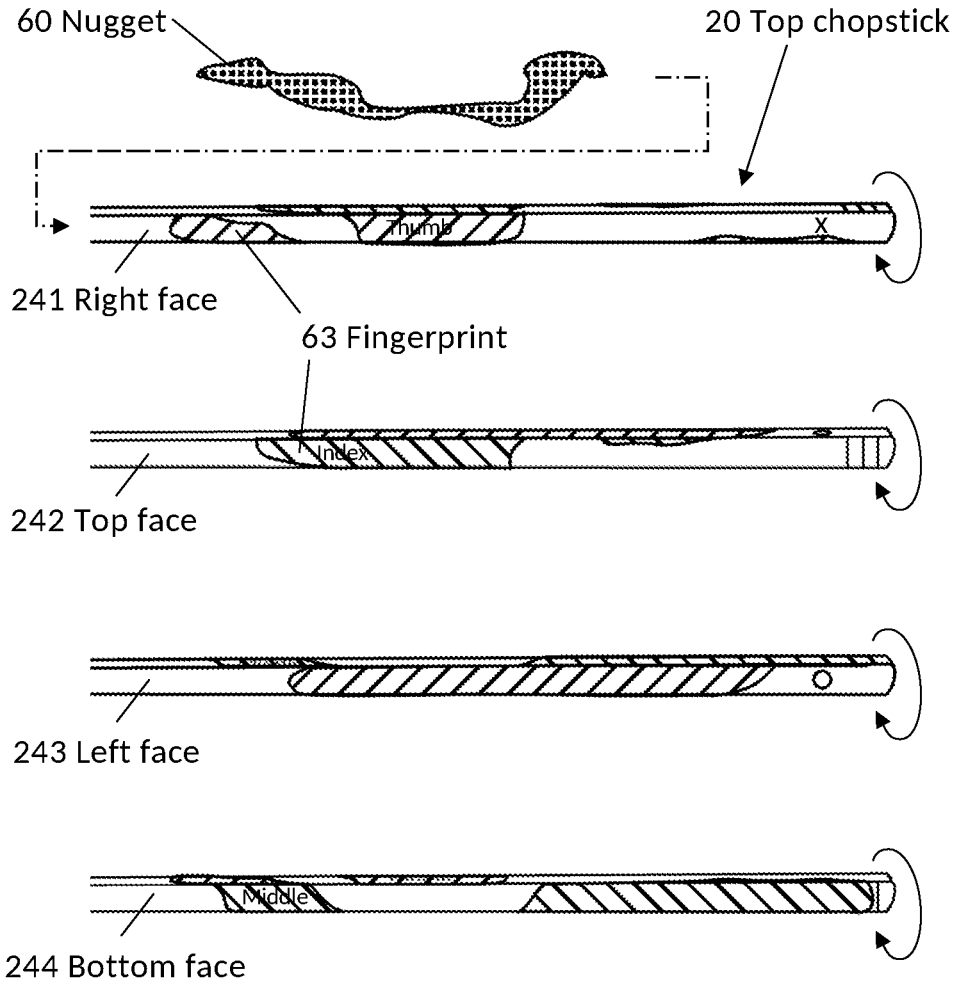
FIG. 14T is a view of the second embodiment of the present invention, where the top ergonomic nugget is a removable attachment to a plain top chopstick, demonstrating that the contiguous fingerprint on the plain top chopstick is identical to the one from the first embodiment shown in FIG. 12T.

For clarity, fingerprint 63 from FIG. 12T is reproduced in FIG. 14T with the top nugget detached, so that its irregular shape and its contiguousness can be more clearly illustrated. Similarly, fingerprints 64 and 65 from FIG. 12B are reproduced in FIG. 14B with the bottom nugget detached.

A corollary of the above is that ergonomic nuggets and their contact interfaces generally touch fingers and provide feedback, only on areas outside of stickprints. That is, while actual 3D shapes of nugget portions are bound only by human imagination, these nugget protrusions must not interfere with finger dynamics by incorrectly touching areas inside stickprints meant for contacts with actual chopstick surfaces. This design constrain is known as the "preservation of stickprints". Take the "limit" interfaces on the top chopstick as an example; it can be confirmed that interfaces 41, 42, 43, 44*a* and 44*b* (FIG. 7W), and interfaces 45, 46, 47*a*, 47*b*, 48 and 49 (FIG. 9C) touch fingers only at the perimeter of stickprints 163*t*, 163*i* and 163*m* (FIG. 13T).

For the bottom chopstick, however, the interactions are more complicated. The "guide" contact interfaces in FIG. 7W and FIG. 9C hug the ring finger and the thumb, as the bottom chopstick rolls. Because they are not "limit" interfaces, they do not strictly sit on the perimeter of stickprints 165*t* and 165*r* shown in FIG. 13B. They touch fingers at the perimeters of moving stick marks instead. As the bottom chopstick rolls, these stick marks advance as illustrated in FIG. 11T and FIG. 11B. The "guide" contact interfaces advance in lockstep with moving stick mark perimeters during the alternating motion. For the purpose of the disclosure, we will still refer to this constrain on stick marks as the "preservation of stickprints". After all, stick marks make up stickprints.

Re-Definition of Unrestricted Chopsticks

We can now redefine "unrestricted chopsticks" more succinctly and more accurately. Unrestricted chopsticks are chopsticks that preserve standard grip fingerprints and stickprints. The first embodiment, for instance, preserves fingerprints 63, 64 and 65, identified in FIG. 12T and FIG. 12B, and stickprints 163*t*, 163*i*, 163*m*, 164*r*, 165*t* and 165*p*, identified in FIG. 13T and FIG. 13B. By preserving both fingerprints and stickprints, unrestricted chopsticks replicate exact finger dynamics and finger experiences of plain chopsticks.

Here is what this redefinition means. Only the "fingerprint" areas of unrestricted chopsticks need to be identical to those of plain chopsticks. The rest of unrestricted chopsticks can be altered, carved, enlarged, shortened or lengthened. However, these modifications are subject to the constraint that they not hinder the twirling of chopsticks by fingers throughout the alternating motion. Specifically, modifications are subject to the requirement to preserve "stickprints" on fingers. When unrestricted chopsticks are allowed to make identical stickprints to those made by plain chopsticks, then the modifications are considered not to intrude on finger movements.

Re-Definition of Ergonomic Chopsticks

We can now redefine "ergonomic chopsticks" more succinctly and more accurately as well. Ergonomic chopsticks are unrestricted chopsticks with ergonomic nuggets that provide limit feedback and guide feedback to fingers. For the first embodiment, for instance, ergonomic nuggets are situated outside of fingerprints 63, 64 and 65, illustrated in FIG. 12T and FIG. 12B. Thus, fingers are able to touch and grip ergonomic chopsticks in exactly the same places as they would a pair of plain chopsticks. Ergonomic nuggets serve their limit and guide functions without interfering with finger movements, allowing plain chopstick surfaces to leave stickprints 163*t*, 163*i*, 163*m*, 164*r*, 165*t* and 165*p* on fingers, as illustrated in FIG. 13T and FIG. 13B. Any pair of unrestricted chopsticks providing tactile feedback via nugget portions are ergonomic chopsticks.

Differentiation

In contrast to ergonomic chopsticks, many published devices put pads, tabs, hoops, rings, balls, hinges or carved grooves within standard grip fingerprints. They prioritize goals that go against the definition of unrestricted chopsticks, and against the teaching of the standard grip and its alternating motion. These published devices compromise the dynamics of the planetary gear train.

For instance, some published devices deform chopsticks or affix conspicuous appendages to chopsticks, with the explicit goal of enforcing the correct initial finger placement as shown in FIG. 2C. But these devices assume that the same finger configurations apply throughout the alternating motion, including the wide-open posture as shown in FIG. 2W. When users attempt to apply principles of the planetary gear train to twirl both chopsticks, the deformed parts or appendages come in contact with fingers, and hinder the alternating motion. As a result, these alternatively-shaped chopsticks often curtail the range of finger motion, limit chopstick rolls, and change the dynamics of finger movements. They teach incorrect finger dynamics, and weaken mechanical advantages. They are not unrestricted chopsticks.

Some published devices deviate one step further from unrestricted chopsticks—they alter the way fingers hug, push, pull or drag surfaces of chopsticks, with the explicit goal of avoiding the need to learn to maneuver chopsticks. These come with mounted finger hoops or sleeves, to couple fingers to chopsticks. They allow users to affect the appearance of the alternating motion of the standard grip, and to move the chopsticks as extensions of fingers, without having to apply standard grip finger dynamics. They do not preserve standard grip fingerprints. They do not teach the planetary gear train dynamics. Experiences learned on these devices do not translate to plain chopsticks. These devices are not unrestricted chopsticks.

Some published devices with hoops and sleeves further add a simulated chopstick pivot in the form of a hinge, to avoid the need to learn the finger posture of the standard grip. The hinge couples the two chopsticks, generally under the tip segment of the thumb, holding chopsticks in the configuration shown in FIG. 2C, without users having to place fingers in the same way as depicted in the illustration. Instead, users can simply grip just one of these coupled chopsticks, and the other chopstick will follow. The hinge allows chopsticks to extend and flex without rolling. In fact, the hinge explicitly makes both chopstick unrollable. When users maneuver the top chopstick via hoops or sleeves, hinge surfaces and the moving top chopstick rub against the skin of the thumb, if the thumb is placed on the hinge as prescribed by the standard grip. Most users quickly learn to move the thumb away from the top chopstick, and instead rest the thumb on the bottom chopstick. These coupled chopsticks are one of the most popular training chopsticks for children, in the market today. But they do not teach even the correct finger posture. These devices are not unrestricted chopsticks.

Lastly, some published devices eschew the standard grip altogether. These usually connect two sticks by their rear ends, instead of under the thumb. The resulting devices look like tweezers or tongs, instead of chopsticks. They can never be wielded with the standard grip posture as shown in FIG. 2C. They require finger posture and finger dynamics applicable to tweezers and tongs. These devices are not unrestricted chopsticks.

A Method to Design Ergonomic Chopsticks

This disclosure not only teaches embodiments of ergonomic chopsticks, but also lays out a method of designing all ergonomic chopsticks that uphold the standard grip and its alternative motion.

First, find a suitable pair of plain chopsticks, and choose a person whose hand is of the desired size. Determine the right location to grip these chopsticks as shown in FIG. 1C. This becomes the closed posture, tailored to these chopsticks. Twirl chopsticks and determine the limit for the wide-open posture, as shown in FIG. 1W. Finger movements from closed to wide-open, and back, define the range of the alternating motion for these chopsticks.

Apply ink to fingers and the purlicue, then twirl chopsticks again, carefully leaving precise finger impressions on both chopsticks. The impressions create fingerprints tailored to these chopsticks, similar to how fingerprint 63 (FIG. 14T) and fingerprints 64/65 (FIG. 14B) are tailored to a pair of standard square Japanese chopsticks. Instead of ink impressions, fingerprints on chopsticks may also be drawn by tracing the contour of fingers at the closed posture and the wide-open posture, and then combining these into contiguous fingerprints. These fingerprint areas are off-limits to ergonomic nuggets. They represent chopstick surfaces that must be preserved.

Now, similarly record "wide-open" stick marks at the wide-open posture as shown in FIG. 7W, by ink marks or by tracing contour of chopsticks on fingers. Repeat the same process for the closed posture as shown in FIG. 9C, and record "closed" stick marks. Once this is done, create and record combined stickprints from these stick marks, similar to how this is done for square Japanese chopsticks—consult FIG. 11T, FIG. 11B, FIG. 13T, and FIG. 13B.

In general, a perimeter of one stick mark or one stickprint can be divided into 4 sections: 2 longitudinal sections on opposing sides that run along the longitudinal axis of the chopstick, plus the remaining 2 opposing sections called lateral sections. The lateral sections of stick marks are prime candidates for slip limit interfaces and roll guide interfaces to make contact with fingers. Whenever a longitudinal section from a stick mark lines up with a longitudinal section from a stickprint, that section is a prime candidate for roll limit interfaces to make contact.

Decide on a theme for the ergonomic nuggets. For instance, the first embodiment disclosed here optimizes for minimalism and inconspicuousness. Other themes may be chosen, such as the recreation of a recognizable and beautiful object using nugget protrusions. Mix slow-curing epoxy putty, and apply epoxy to the top chopstick, outside of any fingerprint areas on the top chopstick, similar to how it is done for square chopsticks, as shown in FIG. 12T. Shape putty into nugget portions based on the chosen theme, and at the same time consider how surfaces of top nugget portions interact with stick marks recorded above, at both ends of the alternating motion, and throughout the alternating motion. Using FIG. 6W and FIG. 8C as inspirations, and taking above description of prime candidate perimeter sections, designate roll limit interfaces, slip limit interfaces and roll guide interfaces. Then revise top nugget portions to maximize effects of these interfaces, while ensuring that reshaped nugget portions do not intrude on fingerprint areas. Repeat the process and create bottom nugget portions on the bottom chopstick—consult FIG. 12B, FIG. 6W and FIG. 8C.

Hold both of these newly-shaped "ergonomic chopsticks", and twirl them. Check that nuggets preserve recorded stickprints. That is, make sure that they do not intrude on finger skin that must grip chopstick surfaces (aka fingerprints), at every step throughout the alternating motion. Revise nuggets as needed to eliminate nugget portions that interfere with stickprints.

Once the epoxy hardens, label "Thumb", "Index" and "Middle" on the top chopstick, similar to how it is done for square chopsticks, shown in FIG. 14T. Label "Thumb" and "Ring" on the bottom chopstick, similar to that shown in FIG. 14B. The best locations for these labels are within fingerprints. Position labels such that they are covered by respectively-named fingers, at the closed posture, as shown in FIG. 8C—all labels visible in FIG. 14T and FIG. 14B are covered by fingers in FIG. 8C.

A new embodiment of ergonomic chopsticks is born. Hardened nuggets can now be used as a mold or a 3D model to mass-produce ergonomic chopsticks.

Alternative Embodiments

While the disclosure is susceptible to various modifications and alternative constructions, certain illustrative embodiments are shown in the drawings and are described in detail. The disclosure also teaches a method of designing ergonomic chopsticks which can be used to produce embodiments beyond those illustrated here. It should be understood, therefore, that there is no intention to limit the disclosure to the specific embodiments and methods disclosed, but on the contrary, the intention is to cover all modifications, alternative constructions, combinations, and equivalents falling within the spirit and scope of the disclosure.

Choices for plain chopsticks are not limited to square Japanese ones. Chinese style, hexagonal, octagonal, and even round chopsticks can be used as base models on which ergonomic nuggets are mounted. Different types of plain chopsticks will have slightly different variations of stickprints and fingerprints. Square chopsticks, as used in the first embodiment shown in FIG. 4W and FIG. 4C allow fingers to leave fingerprints as illustrated in FIG. 14T and FIG. 14B. Same square chopsticks leave stickprints as illustrated in FIG. 13T and FIG. 13B. But hexagonal and round chopsticks will have fingerprint areas of modified shapes. The fingerprint areas will also differ based on how far back a user holds chopsticks. For instance, FIG. 2W and FIG. 2C show that roughly one third of the top chopstick is behind the thumb. With a shorter rear end, it will be possible to extend the tips even further apart, and thus a revised set of fingerprints needs to be considered. These considerations are covered in the "method" section earlier.

Furthermore, each type of chopsticks has subtly-different finger dynamics and mechanical advantages. The square chopsticks are used in many embodiments in this disclosure for the convenient fact that a chopstick edge runs through fingerprint 63 (FIG. 12T and FIG. 14T), across the area making contact with the thumb stickprint 163*t* (FIG. 13T). The edge gives the thumb great leverage in rolling top chopstick 20 back and forth. This insight on accumulated fingerprints, chopstick edges, and the role of the roll is overlooked in published devices, resulting often in purported finger aids, guides, grooves, and surfaces that actually cause the thumb and other fingers to lose traction during the alternating motion.

For all embodiments, further-derived forms can be produced to accommodate righthanded users, lefthanded users, children, adults, and other hand shapes or sizes in between. The standard grip fingerprint surfaces will be different for different types and sizes of hands—contact interfaces and guide surfaces can be revised accordingly. Some ergonomic nuggets and chopsticks may even be made to personal orders. These considerations are covered in the "method" section earlier.

The first embodiment shown in FIG. 5T and FIG. 5B have names of fingers inscribed on surfaces to be covered by respective fingers at the closed posture, as an identification aid for beginners. These labels are not needed in other embodiments intended for advanced users.

The second embodiment of the present invention is shown in FIG. 14T and FIG. 14B. In this embodiment, the two ergonomic nuggets from the first embodiment in FIG. 12T and FIG. 12B become removable attachments, nuggets 60 and 61, to be mounted on plain chopsticks 20 and 30. In addition to flexible choices of plain chopsticks, removable nuggets allow users to set the longitudinal location of nuggets on chopsticks, based on personal preferences. The views of top nugget 40 of the first embodiment in FIG. 5T provide hints on how the detachable top nugget 60 of the second embodiment may work. Nugget 60 (FIG. 14T) can be made, for instance, with an elastic material, and clipped onto a plain chopstick. As for detachable bottom nugget 61 (FIG. 14B), its spiral shape naturally provides a good mounting mechanism, when nugget 61, too, is made from elastic materials. This second embodiment continues to uphold standard grip fingerprint and stickprint experiences.

In other embodiments, the ergonomic nuggets themselves may be embellished, re-textured, colored, reshaped, or otherwise modified. Nugget portions may be more generously allocated instead of being low-profile and parsimonious, as long as they do not interfere with the full range of standard grip finger motions. For instance, these nugget portions may be shaped to provide tactile feedback to new surfaces of fingers, in addition to previously-discussed contact interfaces shown in FIG. 6W and FIG. 8C. Specifically, the contact interface 49 in FIG. 8C may be enlarged by a prolonged nugget. Or, the interfaces may be shifted to touch other surfaces of the index finger, even behind from the back of the finger, with a taller nugget.

In the first embodiment shown in FIG. 6W and FIG. 8C, bottom nugget 50 is a single-loop spiral. In alternative embodiments, the bottom nugget can be shaped instead into a multi-loop spiral. The elongated spiral would enable more extensive offset adjustment without losing tactile feedback to the ring finger and the thumb, at the two extreme ends of the adjustment range.

Figure 15W:
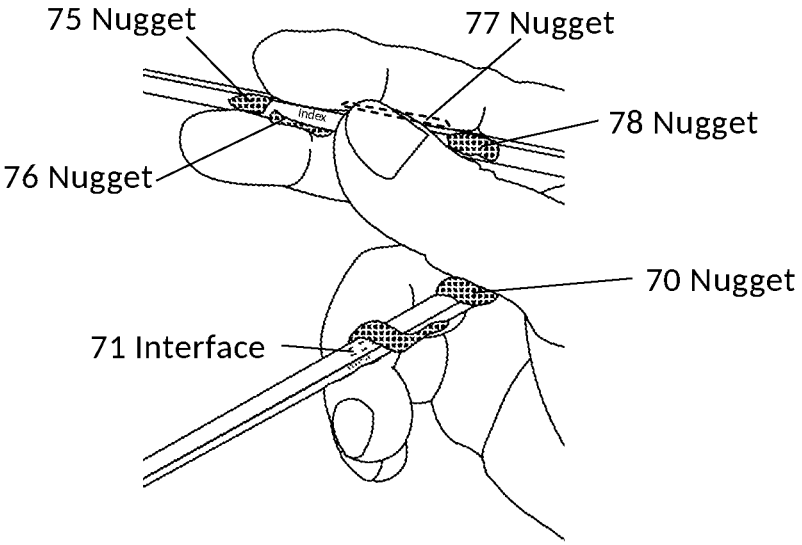
FIG. 15W is a view at the wide-open posture, of the third embodiment on the bottom chopstick, and the fourth embodiment on the top chopstick, where the top chopstick houses four disjoint nugget portions, and the bottom chopstick has an elongated spiral nugget providing roll-limit feedback to the ring finger via an additional contact interface.
Figure 15C:
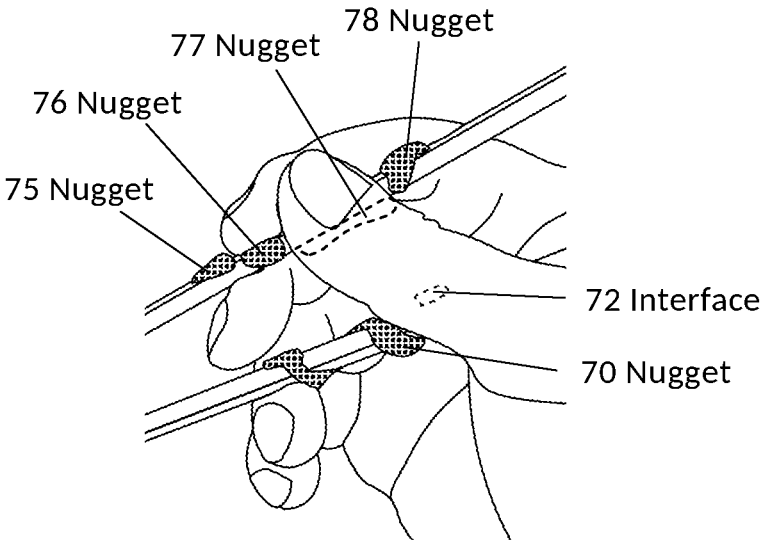
FIG. 15C is a view at the closed posture, of the third embodiment on the bottom chopstick, and the fourth embodiment on the top chopstick, where the top chopstick houses four disjoint nugget portions, and the bottom chopstick has an elongated spiral nugget providing roll-limit feedback to the thumb via an additional contact interface.

In the third embodiment, illustrated in FIG. 15W and FIG. 15C, the bottom nugget 70 is a modified version of nugget 50 from FIG. 6W and FIG. 8C. The spiral shape of this bottom nugget 70 is extended slightly longer, with additional nugget portions at both ends of the spiral, such that these additional portions can provide end-of-roll feedback to the ring finger and the thumb, for rolling the bottom chopstick. This is similar to how contact interface 49 in FIG. 8C caps the end of top chopstick's clamping movement, by pressing against the base of the index finger. FIG. 15W shows a third portion of the bottom nugget 70 providing contact interface 71 to the ring finger, to cap the roll of the bottom chopstick at the wide-open end of the alternating movement. Thus interface 71 is a wide-open-limit contact interface. FIG. 15C shows a fourth portion of the nugget 70 providing contact interface 72 to the thumb, to cap the roll of the bottom chopstick at the end of the clamping movement. Thus interface 72 is a closed-limit contact interface. In this third embodiment, the standard grip fingerprint and stickprint experience continues to be upheld.

In the fourth embodiment, illustrated again in FIG. 15W and FIG. 15C, multiple individual nugget portions are found on the top chopstick. Instead of connecting all portions into one single ergonomic nugget on the top chopstick, these portions are left disjoint. Thus, four ergonomic nuggets are visible in these drawings, nugget 75, nugget 76, nugget 77, and nugget 78, roughly corresponding to the first, the second, the third and the fourth nugget portions of the first embodiment in FIG. 5T. These disjoint nuggets are permanently built into the top chopstick, in the fourth embodiment. But they may also be made into removeable attachments in other embodiments. There are many ways to secure disjoint nuggets 75, 76, 77 and 78 in the removable choice, such that they retain their relative position and orientation to one another, including mounting these nuggets on a thin, tubular sleeve into which a top chopstick is inserted. Despite the disjointed nature of these nuggets, they continue to provide similar contact interfaces 41, 42, 43, 44*a*, 44*b*, 45, 46, 47*a*, 47*b*, 48 and 49 from FIG. 6W and FIG. 8C, as previously discussed.

Different embodiments can be applied separately to the top chopstick and the bottom chopstick. For instance, one may be a square chopstick printed on a 3D-printer with a built-in ergonomic nugget, while the other a user's own hexagonal chopstick with a removable nugget attachment. An ergonomic top chopstick can be used with a plain bottom chopstick, as another example. Materials used for nuggets and chopsticks may vary, including rigid metal, wood, bamboo, plastic, flexible rubber, and any nontoxic material. The ergonomic chopsticks may be cast from mold, milled from source materials, printed on 3D-printers, or otherwise produced.

The top and the bottom chopsticks can be connected by a permanent or removable coupling structure to facilitate initial learning, as long as the coupling structure allows the same degrees of extensions, flexions and rolls. This can be achieved without the coupling structure hindering movements of fingers, or altering finger dynamics of the standard grip, throughout the alternating motion. As long as the same standard grip fingerprints and stickprints are preserved, linked chopsticks are still unrestricted chopsticks.

Figure 16:
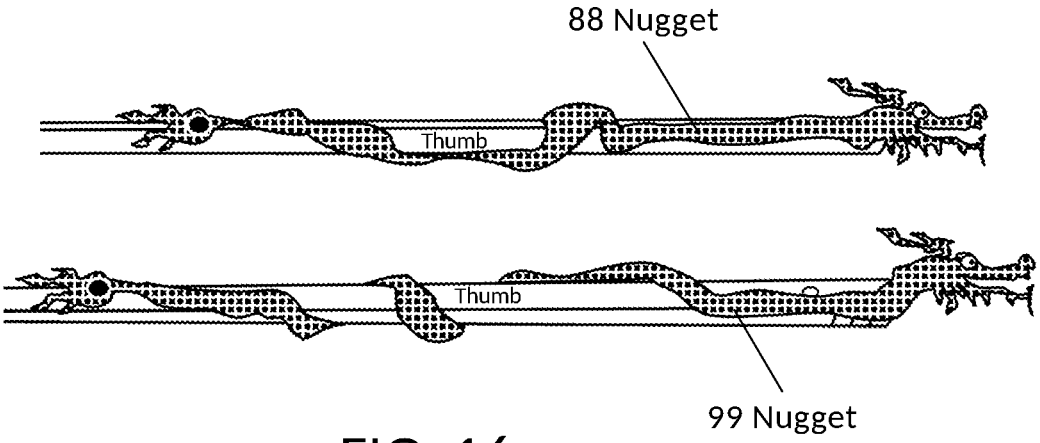
FIG. 16 is a view of the fifth embodiment of the present invention, where each of the two low-profile ergonomic nuggets resembles a Chinese dragon.

Finally, features from many embodiments may be combined, as illustrated by the fifth embodiment shown in FIG. 16. The ergonomic nugget 88 on the top chopstick is generously-allocated. The nugget has been substantially lengthened. Its two ends are reshaped and embellished to look like a Chinese dragon. Similarly, the ergonomic nugget 99 on the bottom chopstick is lengthened. It forms a 2-loop spiral as previously discussed. And its two ends are also reshaped and embellished to look like a second Chinese dragon. Furthermore, both nuggets may be made into removable attachments to plain chopsticks.

Figure 17:
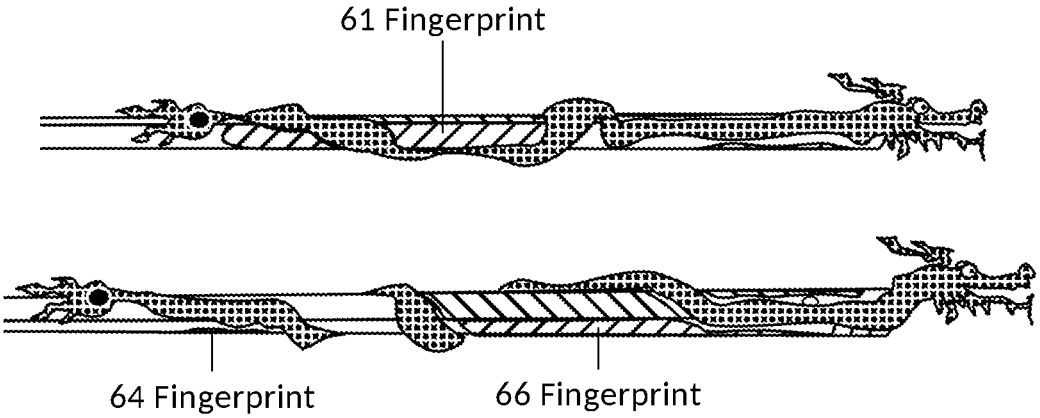
FIG. 17 shows that the two dragon-shaped nuggets from FIG. 16 abut the same standard grip fingerprints as the first embodiment (from FIG. 12T and FIG. 12B), and the second embodiment (from FIG. 14T and FIG. 14B).

Despite the substantial increase in nugget size, no portions of either dragon nugget intrude on standard grip fingerprints 63, 64, or 65. This is confirmed in FIG. 17 where the three fingerprint surfaces are marked on the chopsticks, alongside the two dragon-figure nuggets. These lengthened nuggets have been carefully shaped to avoid intruding on stickprints, as well. As a result, chopsticks mounted with nuggets 88 and 99 remain unrestricted chopsticks. These dragon-shaped nuggets incorporate all contact interfaces of nuggets 40 (FIG. 6W) and 50 (FIG. 8C), thus they are not mere adornment, but provide the same useful feedback as the first embodiment.

CONCLUSION

Ergonomic and plain chopsticks have been classified as "unrestricted chopsticks". Various embodiments of ergonomic chopsticks have been described. They provide tactile feedback to the human hand without intruding on standard grip fingerprints and stickprints. In addition, a method of designing ergonomic chopsticks has been disclosed. It can be used to produce embodiments beyond those illustrated here.

Some differentiating factors that set ergonomic chopsticks and ergonomic nuggets apart from published devices include:

1. Nuggets are tailored to standard grip fingerprints, not to a static finger posture.
2. Chopsticks remain free, not restricted to truncated motions by inter-chopstick linkages.
3. Fingers directly grip surfaces of plain chopsticks, not pads, hoops, or grooves.
4. Rolls are enabled, not hindered by clash of tabs or grooves against stickprints.
5. Surfaces of chopsticks, nuggets and finger roll together, not rub against one another.
6. Ergonomic chopsticks are operated exactly like plain chopsticks, not crutches.
7. Principles of the planetary gear train are honored, not hindered.
8. Dynamics and mechanical advantages of the standard grip are upheld, not weakened.

Benefits of ergonomic chopsticks have been disclosed, including:

1. They guide users to adopt the standard grip and its full range of motion.
2. They allow users to extend the tips of the chopsticks wide apart.
3. They assist users in twirling both chopsticks throughout the alternating motion.
4. They assist users in keeping both chopsticks within position.
5. They enable users to embrace large food items with ease.
6. They enable users to manipulate food items with dexterity.
7. They enable users to hold food items firmly with confidence.
8. Removable embodiments can be attached to a user's own plain chopsticks.

I claim:

1. An ergonomic top chopstick, for use in a hand with the standard grip, held by the thumb, the index finger, the middle finger, and the purlicue, comprising:

a plain chopstick;

said chopstick serving as a top chopstick according to the standard grip;

said chopstick being provided with a food-gripping tip at its forward end;

said chopstick being provided with in general a top face, a right face, a bottom face, and a left face;

said chopstick being provided with a thumb space on said right face, suitable for receiving the tip segment of the thumb, for initial placement according to the standard grip;

said chopstick being provided with an index space on said top face, located longitudinally forward of said thumb space, suitable for receiving the index finger;

said chopstick being provided with a middle space on said bottom face, starting forward of and overlapping partially with said index space, suitable for receiving the middle finger;

a first nugget portion being mounted on said top face, forward of said index space;

a second nugget portion being mounted on said right face, forward of said thumb space;

a third nugget portion being mounted on said bottom face, behind said middle space; and a fourth nugget portion being mounted on said right face, behind said thumb space; and said chopstick being provided with a fingerprint area on said top face, said right face, said bottom face, and said left face, as defined by accumulated impressions generated by the thumb, the index finger, the middle finger, and the purlicue throughout an alternating motion between a wide-open posture and a closed posture, forming a contiguous area including a portion of said left face immediately aft of said middle space with twice the length of said thumb space, and a portion of said bottom face immediately aft of said thumb space with one and a half times the length of said thumb space; and said fingerprint area presenting bare chopstick surface for the hand to grip.

2. The ergonomic top chopstick of claim 1 wherein said thumb space, said index space, and said middle space are explicitly labeled.

3. The ergonomic top chopstick of claim 1 wherein said nugget portions are built permanently into said top chopstick.

4. The ergonomic top chopstick of claim 1 wherein said nugget portions are built as removable attachments to said top chopstick.

5. The ergonomic top chopstick of claim 1 wherein said nugget portions are connected as parts of one contiguous nugget body.

6. The ergonomic top chopstick of claim 5 wherein:

said nugget body includes a section in the form of a squashed U-shape with serif; and said U-shaped section forms a clip, with the serif and the bottom of said U-shape sandwiching said top face and said bottom face, respectively.

7. The ergonomic top chopstick of claim 6 wherein:

said nugget body is low-profile, with any point on a surface of said nugget body being within 3/16 inch, or 5 mm, of a surface of said chopstick; and said nugget body is small, with any point on the surface of said body being within ¼ inch, or 6.35 mm, of a finger holding said chopstick at the initial placement.

8. The ergonomic top chopstick of claim 6 wherein:

said nugget body resembles a Chinese dragon; and said chopstick is a square Japanese chopstick measuring about 9 inches, or 23 cm, long.

9. An ergonomic bottom chopstick, for use in a hand with the standard grip, held by the thumb, the ring finger, and the purlicue, comprising:

a plain chopstick;

said chopstick serving as a bottom chopstick according to the standard grip;

said chopstick being provided with a food-gripping tip at its forward end;

said chopstick being provided with in general a top face, a right face, a bottom face, and a left face;

said chopstick being provided with a thumb space on said top face, suitable for receiving the base segment of the thumb, for initial placement according to the standard grip;

said chopstick being provided with a ring space on said bottom face, located longitudinally forward of said thumb space, suitable for receiving the ring finger;

a first nugget portion being mounted on said bottom face, behind said ring space; and a second nugget portion being mounted on said top face, forward of said thumb space; and said chopstick being provided with a ring fingerprint area on said bottom face and said left face, as defined by accumulated impressions generated by the ring finger throughout an alternating motion between a wide-open posture and a closed posture, forming a contiguous area including a portion of said left face bordering said ring space; and said ring fingerprint area presenting bare chopstick surface for the hand to grip; and said chopstick being provided with an aft fingerprint area on said top face, said right face, said bottom face, and said left face, as defined by accumulated impressions generated by the thumb and the purlicue throughout the alternating motion, forming a contiguous area including a portion of said right face bordering said thumb space, a portion of said left face immediately aft of said thumb space with a length equal to that of said thumb space, and a portion of said bottom face immediately aft of said thumb space with a length equal to that of said thumb space; and said aft fingerprint area presenting bare chopstick surface for the hand to grip.

10. The ergonomic bottom chopstick of claim 9 wherein said thumb space and said ring space are explicitly labeled.

11. The ergonomic bottom chopstick of claim 9 wherein said nugget portions are built permanently into said bottom chopstick.

12. The ergonomic bottom chopstick of claim 9 wherein said nugget portions are built as removable attachments to said bottom chopstick.

13. The ergonomic bottom chopstick of claim 9 wherein said nugget portions are connected as parts of one contiguous nugget body.

14. The ergonomic bottom chopstick of claim 13 wherein:

said nugget body forms a spiral shape; and said spiral shape winds clockwise from said ring space towards said thumb space, from the perspective of a user looking down the tip of said chopstick towards the rear.

15. The ergonomic bottom chopstick of claim 14 wherein:

said nugget body is low-profile, with any point on a surface of said nugget body being within 3/16 inch, or 5 mm, of a surface of said chopstick; and said nugget body is small, with any point on the surface of said body coming within ¼ inch, or 6.35 mm, distance from a finger holding said chopstick, at some point during an alternating motion.

16. The ergonomic bottom chopstick of claim 14 wherein:

said nugget body resembles a Chinese dragon; and said chopstick is a square Japanese chopstick measuring about 9 inches, or 23 cm, long.

17. The ergonomic bottom chopstick of claim 9, further comprising:

a third nugget portion being mounted on said top face, parallel to said ring space; and a fourth nugget portion being mounted on said left face, parallel to said thumb space.

18. A method for designing an ergonomic chopstick, for use in a hand with the standard grip, comprising:

choosing a plain chopstick;

choosing a role for said chopstick, either as a top chopstick or as a bottom chopstick;

choosing a hand to wield said chopstick with the standard grip for said role;

choosing a longitudinal position on said chopstick for fingers of said hand to grip it;

recording fingerprints from accumulated finger and purlicue impressions on said chopstick, throughout an alternating motion, from a closed posture to a wide-open posture, with said chopstick wielded by said hand for said role at said position;

recording wide-open stick marks made by said chopstick on fingers and the purlicue of said hand at the wide-open posture;

recording closed stick marks made by said chopstick on said fingers and said purlicue at the closed posture;

recording stickprints by combining all stick marks made throughout the alternating motion, including said wide-open stick marks and said closed stick marks;

choosing a theme for ergonomic nugget portions;

locating said nugget portions outside of said fingerprints, generally around the perimeter of said fingerprints, but also specifically displaced per said theme, as long as said nugget portions remain outside of said fingerprints;

designating slip-limit interfaces on said nugget portions, by reshaping said nugget portions to make contact with said gripping fingers at lateral perimeter sections of said wide-open stick marks and said closed stick marks;

twirling said chopstick from the wide-open posture to the closed posture, and back, to confirm that no parts of said nugget portions prevent finger skin in said stickprint areas from gripping chopstick surfaces in said fingerprint areas; and removing or reshaping said nugget portions that prevent finger skin in said stickprint areas from gripping chopstick surfaces in said fingerprint areas during said twirling.

19. The method of claim 18 further comprising:

designating roll-limit interfaces on said portions, by reshaping said portions to make contact with said gripping fingers at longitudinal perimeter sections of said stickprints that match same sections from said wide-open stick marks or said closed stick marks.

20. The method of claim 18 wherein said role is a bottom chopstick, further comprising:

extending and reshaping said slip-limit interfaces on said portions to remain in contact with said gripping fingers throughout said twirling, turning said slip-limit interfaces into roll-guide interfaces.

* * * * *